US009430906B2

(12) United States Patent
Aoki et al.

(10) Patent No.: US 9,430,906 B2
(45) Date of Patent: Aug. 30, 2016

(54) WAGERING GAME HAVING ADJACENT-REEL FUNCTIONALITY ENHANCEMENTS

(71) Applicant: WMS Gaming Inc., Waukegan, IL (US)

(72) Inventors: Dion K. Aoki, Chicago, IL (US); Benjamin T. Gomez, Chicago, IL (US); Joel R. Jaffe, Glenview, IL (US); Jeffry L. Nauman, Yorkville, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 168 days.

(21) Appl. No.: 13/787,180

(22) Filed: Mar. 6, 2013

(65) Prior Publication Data

US 2013/0344939 A1 Dec. 26, 2013

Related U.S. Application Data

(60) Provisional application No. 61/663,808, filed on Jun. 25, 2012.

(51) Int. Cl.
*G07F 17/32* (2006.01)
*G07F 17/34* (2006.01)

(52) U.S. Cl.
CPC ..... *G07F 17/326* (2013.01); *G07F 17/3265* (2013.01); *G07F 17/3288* (2013.01); *G07F 17/34* (2013.01)

(58) Field of Classification Search
CPC . G07F 17/34; G07F 17/3265; G07F 17/3211; G07F 17/3213; G07F 17/3267; G07F 17/3286
See application file for complete search history.

(56) References Cited

U.S. PATENT DOCUMENTS

| | | | | |
|---|---|---|---|---|
| 6,375,570 | B1 * | 4/2002 | Poole | 463/31 |
| 6,517,433 | B2 | 2/2003 | Loose et al. | 463/20 |
| 7,226,359 | B2 * | 6/2007 | Bussick et al. | 463/20 |
| 7,758,414 | B1 * | 7/2010 | Marks et al. | 463/20 |
| 8,002,625 | B2 * | 8/2011 | Maya | 463/20 |
| 8,105,145 | B2 * | 1/2012 | Jaffe | 463/16 |
| 2003/0064779 | A1 * | 4/2003 | Suda | 463/20 |
| 2006/0068881 | A1 * | 3/2006 | Casey | G07F 17/3265 463/20 |
| 2006/0264254 | A1 | 11/2006 | Aoki | 463/20 |
| 2007/0060261 | A1 | 3/2007 | Gomez | 463/16 |
| 2008/0188280 | A1 * | 8/2008 | Marks et al. | 463/20 |
| 2008/0188286 | A1 * | 8/2008 | Jaffe | 463/20 |
| 2009/0227356 | A1 * | 9/2009 | Moroney | 463/20 |
| 2009/0253491 | A1 | 10/2009 | Gomez et al. | 463/20 |
| 2010/0016054 | A1 * | 1/2010 | Berman et al. | 463/18 |
| 2010/0016061 | A1 | 1/2010 | Gomez et al. | 463/20 |
| 2010/0062196 | A1 | 3/2010 | Bezek et al. | 428/35.2 |

(Continued)

*Primary Examiner* — James S McClellan
*Assistant Examiner* — Kevin Carter
(74) *Attorney, Agent, or Firm* — Nixon Peabody LLP

(57) ABSTRACT

According to one aspect of the present invention, a method of conducting a wagering game on a gaming system includes receiving a wager in response to an input via at least one input device. The method also includes displaying, on at least one display device, a randomly selected outcome of a wagering game in a display area. The display area includes a plurality of reels with a plurality of symbols forming an array. The plurality of symbols includes at least one special symbol. In response to the randomly selected outcome including a special symbol on adjacent ones of the plurality of reels, the method includes changing the functionality of the special symbols on the adjacent ones of the plurality of reels to create a modified array.

15 Claims, 19 Drawing Sheets

(56) References Cited

U.S. PATENT DOCUMENTS

| | | | | |
|---|---|---|---|---|
| 2010/0062829 | A1* | 3/2010 | Chan | 463/20 |
| 2010/0093422 | A1 | 4/2010 | Gomez | 463/20 |
| 2010/0190544 | A1 | 7/2010 | Thomas | 463/20 |
| 2010/0197377 | A1 | 8/2010 | Aoki et al. | 463/20 |
| 2010/0210343 | A1 | 8/2010 | Englman et al. | 463/20 |
| 2010/0234099 | A1 | 9/2010 | Rasmussen et al. | 463/29 |
| 2010/0248811 | A1 | 9/2010 | Jaffe et al. | 463/20 |
| 2013/0017881 | A1* | 1/2013 | Watkins | 463/20 |
| 2013/0084937 | A1* | 4/2013 | Vann | 463/20 |
| 2013/0184045 | A1* | 7/2013 | Vermaak et al. | 463/20 |

* cited by examiner

WAGERING GAME HAVING ADJACENT-REEL FUNCTIONALITY ENHANCEMENTS

CROSS-REFERENCE TO RELATED APPLICATIONS

This application claims the benefit of and priority to U.S. Provisional Patent Application No. 61/663,808, titled "Wagering Game Having Adjacent-Reel Functionality Enhancements" and filed on Jun. 25, 2012, which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to a gaming machine and method of playing a wagering game having an adjacent-reel functionality enhancement feature.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

SUMMARY OF THE INVENTION

According to one aspect of the present invention, a method of conducting a wagering game on a gaming system includes receiving a wager in response to an input via at least one input device. The method also includes displaying, on at least one display device, a randomly selected outcome of a wagering game in a display area. The display area includes a plurality of reels with a plurality of symbols forming an array. The plurality of symbols includes at least one special symbol. In response to the randomly selected outcome including a special symbol on adjacent ones of the plurality of reels, the method includes changing the functionality of the special symbols on the adjacent ones of the plurality of reels to create a modified array. The method further includes evaluating the modified array, using at least one of one or more processors, to determine whether or not the modified array includes a winning combination. The method also includes awarding a payout based on the modified array.

According to another aspect of the invention, a method of conducting a wagering game on a gaming system includes receiving a wager in response to an input via at least one input device. The method also includes displaying, on at least one display device, a randomly selected outcome of a wagering game in a display area. The display area includes a plurality of reels with a plurality of symbols forming an array. The randomly selected outcome includes at least one special symbol. The method further includes providing a first functionality for each of the at least one special symbol on non-adjacent reels of the randomly selected outcome, and providing a second functionality for each of the at least one special symbol on adjacent reels of the randomly selected outcome.

According to yet another aspect of the present invention, a gaming system for conducting a wagering game includes at least one input device, at least one display device, and at least one processor. The gaming system also include at least one memory device storing instructions that, when executed by the at least one processor, cause the gaming system to receive a wager in response to an input via at least one input device and display, on at least one display device, a randomly selected outcome of a wagering game in a display area. The display area includes a plurality of reels with a plurality of symbols forming an array. The plurality of symbols includes at least one special symbol. In response to the randomly selected outcome including a special symbol on adjacent ones of the plurality of reels, the instructions, when executed by the at least one processor, change the functionality of the special symbols on the adjacent ones of the plurality of reels to create a modified array, evaluate the modified array, using at least one of one or more processors, to determine whether or not the modified array includes a winning combination, and award a payout based on the modified array.

Additional aspects of the invention will be apparent to those of ordinary skill in the art in view of the detailed description of various embodiments, which is made with reference to the drawings, a brief description of which is provided below.

Figure 1:
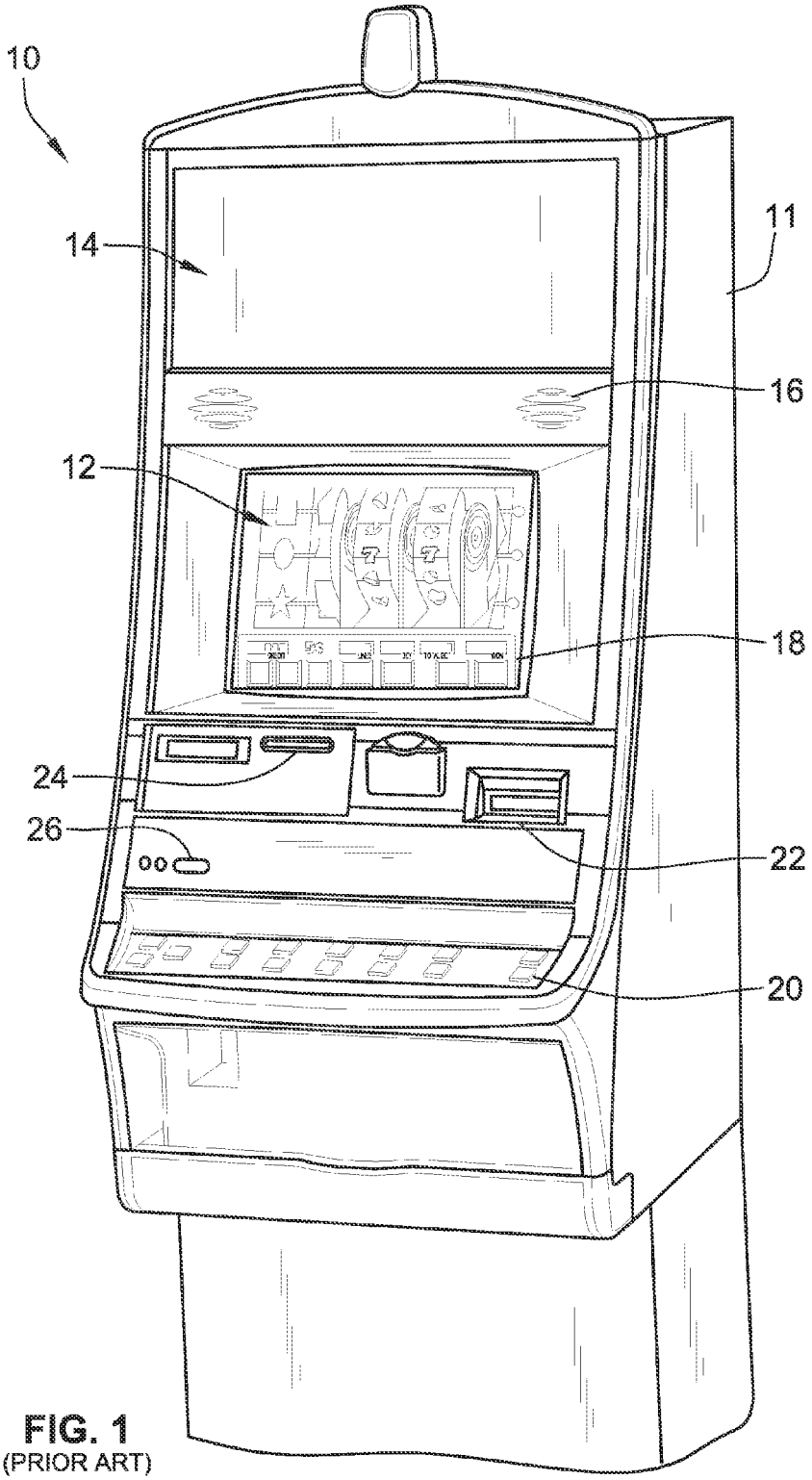
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
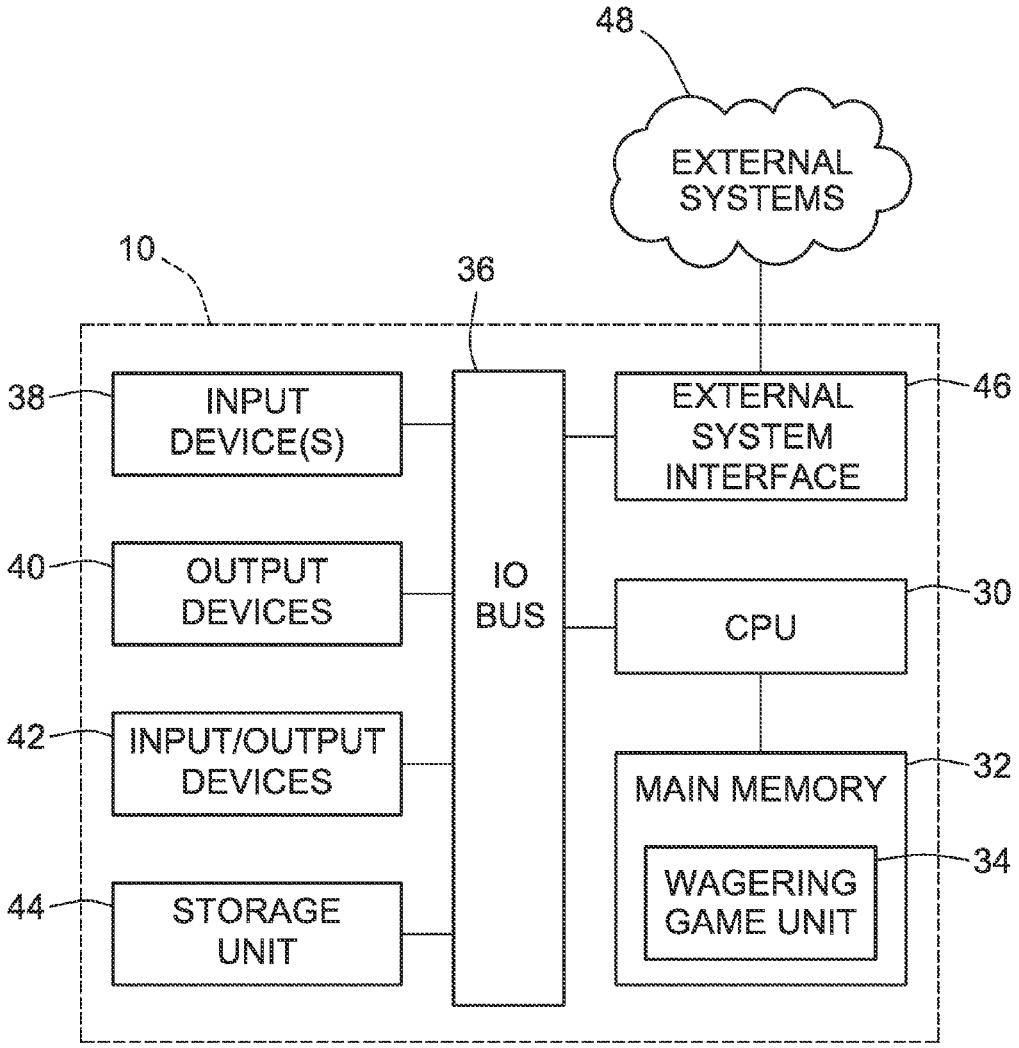
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+ frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
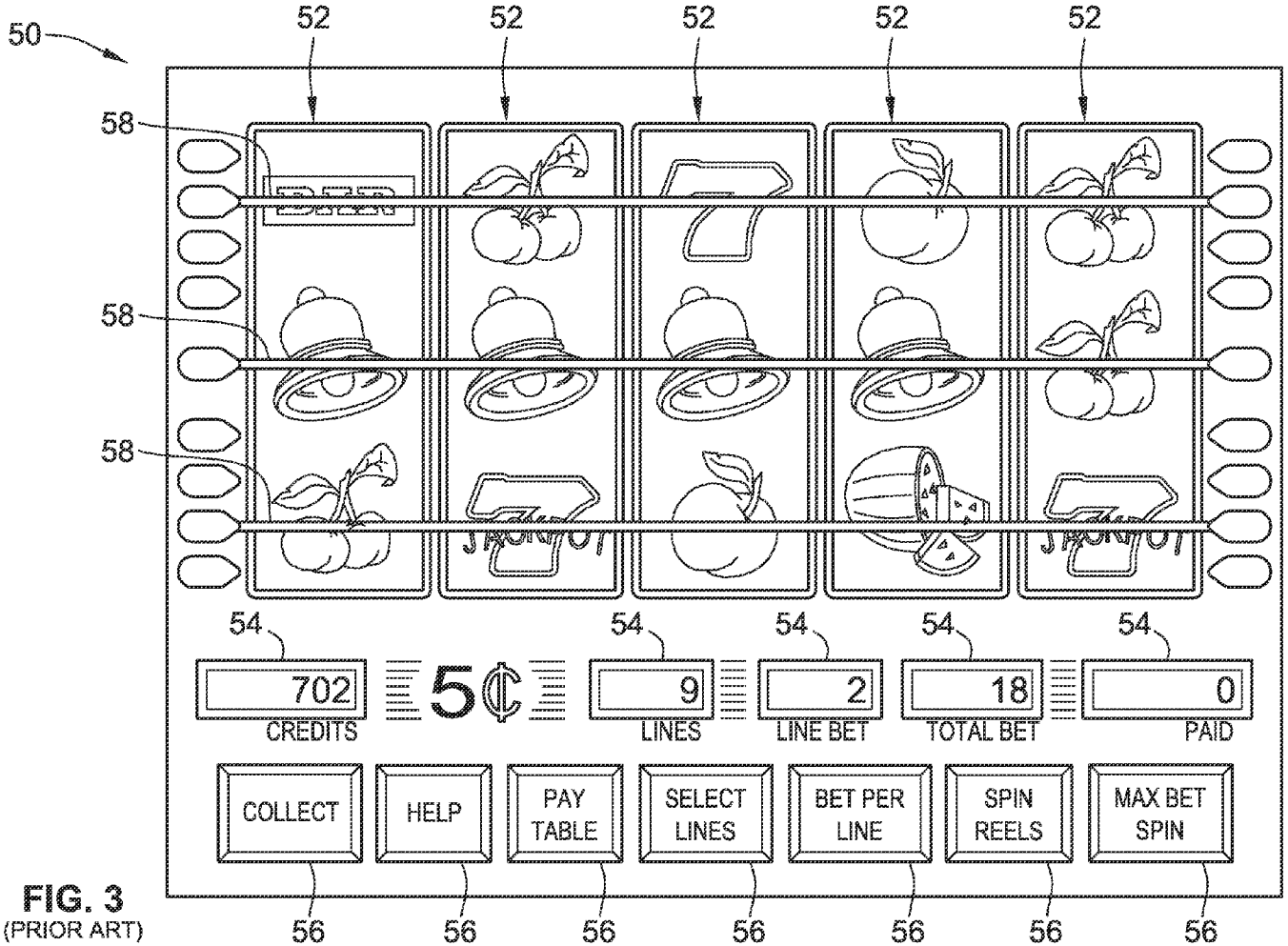
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52*a-e*. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52*a-e* are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Referring now to FIGS. 4-17B, embodiments of a wagering game employing an adjacent-reel functionality enhancement will be described. In a wagering game employing an adjacent-reel functionality enhancement, the functionality of a special symbol is changed or enhanced when a randomly selected outcome of the wagering game includes the special symbol on two or more adjacent reels. In other words, the special symbol can provide a first functionality when the randomly selected outcome includes a special symbol on only one reel or non-adjacent reels and a second functionality when the randomly selected outcome includes one or more special symbols located on adjacent reels. For example, the special symbol can be enhanced from a first functionality to a second functionality by changing the special symbol from a wild to a multiplying wild, a wild to an expanding wild, a wild to an expanding and multiplying wild, an expanding wild to an expanding and multiplying wild, a bonus trigger to an expanding bonus trigger, a bonus trigger to a multiplying bonus trigger, a bonus trigger to an expanding and multiplying bonus trigger, combinations thereof, or the like.

Figure 4:
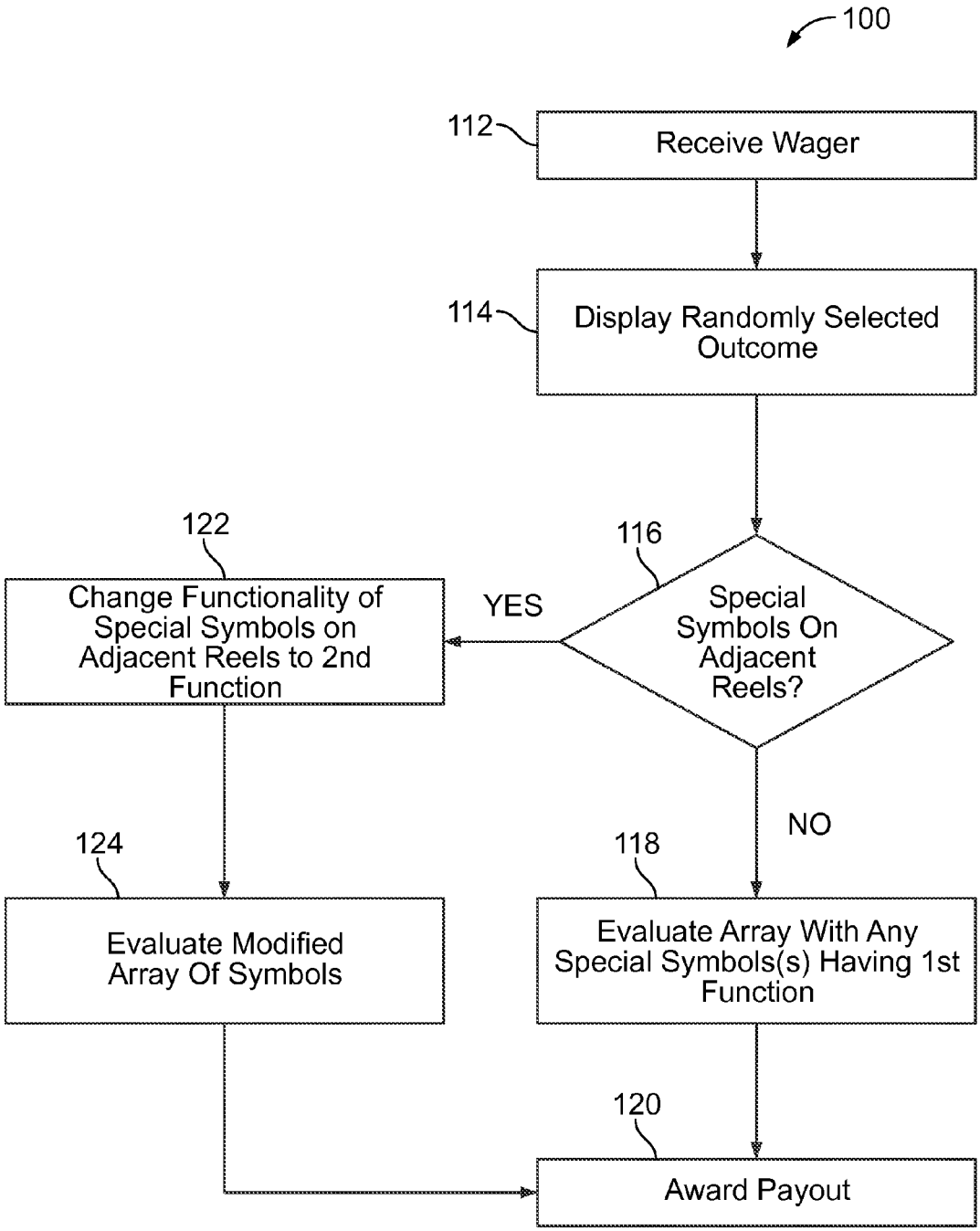
FIG. 4 is a flowchart for an algorithm that corresponds to instructions executed by a controller in accord with at least some aspects of the disclosed concepts.

FIG. 4 is a flowchart for an exemplary algorithm 100 for conducting a wagering game having an adjacent-reel functionality enhancement according to some aspects of the present concepts. At block 112, a wager is received in response to an input provided by a player on an input device of a gaming machine. At block 114, a randomly selected outcome of the wagering game is displayed in a display area (e.g., the primary display 12 and/or the secondary display 14) of a display device. As previously mentioned, the display area includes a plurality of simulated or mechanical reels 52 having symbols thereon. The symbols displayed in the display area for the randomly selected outcome are selected from a plurality of potential symbols, including a special symbol. At decision block 116, the CPU determines whether the randomly selected outcome includes a special symbol on adjacent reels in the display area. If it is determined at block 116 that the randomly selected outcome does not include a special symbol on adjacent reels, then at block 118 the array of symbols displayed on the reels is evaluated with any special symbol(s) having a first functionality to determine whether the array includes any winning combinations and to determine an award amount(s) associated with any winning combinations. Then, at block 120, an award payout is provided for any winning combinations determined at block 118. If, alternatively, it is determined at block 116 that the randomly selected outcome includes a special symbol on at least two adjacent reels, then at block 122 the functionality of the special symbols located on the adjacent reels is changed from the first functionality to a second enhanced functionality to create a modified array. Next, at block 124, the modified array is evaluated to determine whether the modified array includes any winning combinations and to determine an award amount (s) associated with any winning combinations. Then, at block 120, any award payout is provided for any winning combinations determined at block 124.

FIGS. 5-10B illustrate non-limiting examples of wagering-game screens for a wagering game having an adjacent-reel functionality enhancement in which the special symbol provides a wild-symbol functionality when a randomly selected outcome includes a special symbol on only one reel or on non-adjacent reels and a multiplying wild-symbol functionality when a randomly selected outcome includes a special symbol on adjacent reels.

Figure 5:
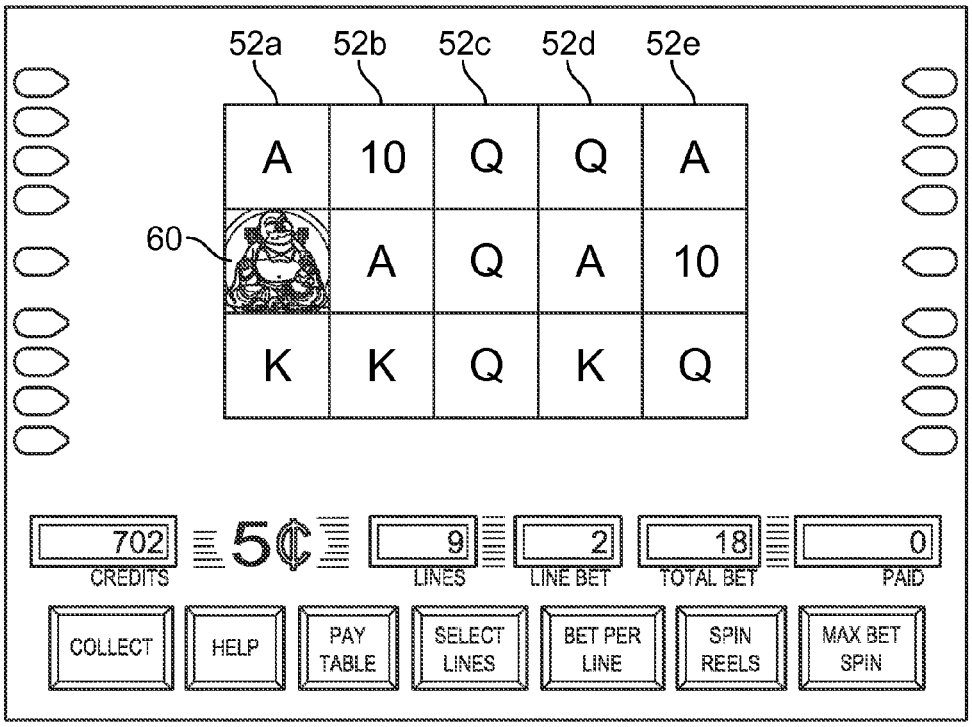
FIG. 5 is an image of an exemplary basic-game screen of a wagering game displayed on a gaming terminal, according to an embodiment of the present invention.

FIG. 5 illustrates a non-limiting example of a wagering-game screen displaying a randomly selected outcome that includes a special symbol located on only one reel. In particular, the randomly selected outcome shown in FIG. 5 includes a special symbol 60 located on only the first reel 52*a*. As the randomly selected outcome does not include another special symbol on an adjacent reel (i.e., the reel 52*b*), a determination of whether the randomly selected outcome includes a winning combination of symbols (e.g., along an active payline) and a determination of an award amount associated with any such winning combination are based on the special symbol 60 providing the wild-symbol function (without a multiplier).

Figure 6:
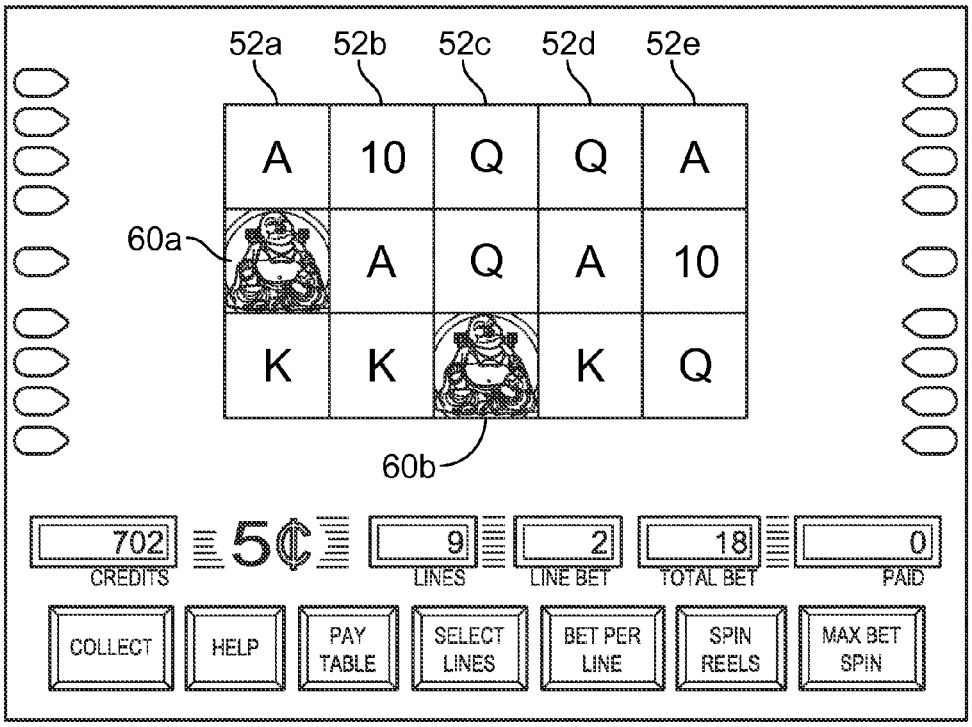
FIG. 6 is an image of an exemplary basic-game screen of a wagering game displayed on a gaming terminal, according to an embodiment of the present invention.

FIG. 6 illustrates a non-limiting example of a wagering-game screen displaying a randomly selected outcome that includes a special symbol on non-adjacent reels. In particular, the randomly selected outcome includes a first special symbol 60*a* located on the first reel 52*a* and a second special symbol 60*b* located on the third reel 52*c*. As the first reel 52*a* is not adjacent to the third reel 52*c*, a determination of whether the randomly selected outcome includes a winning combination of symbols (e.g., along an active payline) and a determination of an award amount associated with any such winning combination are based on the first special symbol 60*a* and the second special symbol 60*b* providing a wild-symbol function (without a multiplier).

Figure 7A:
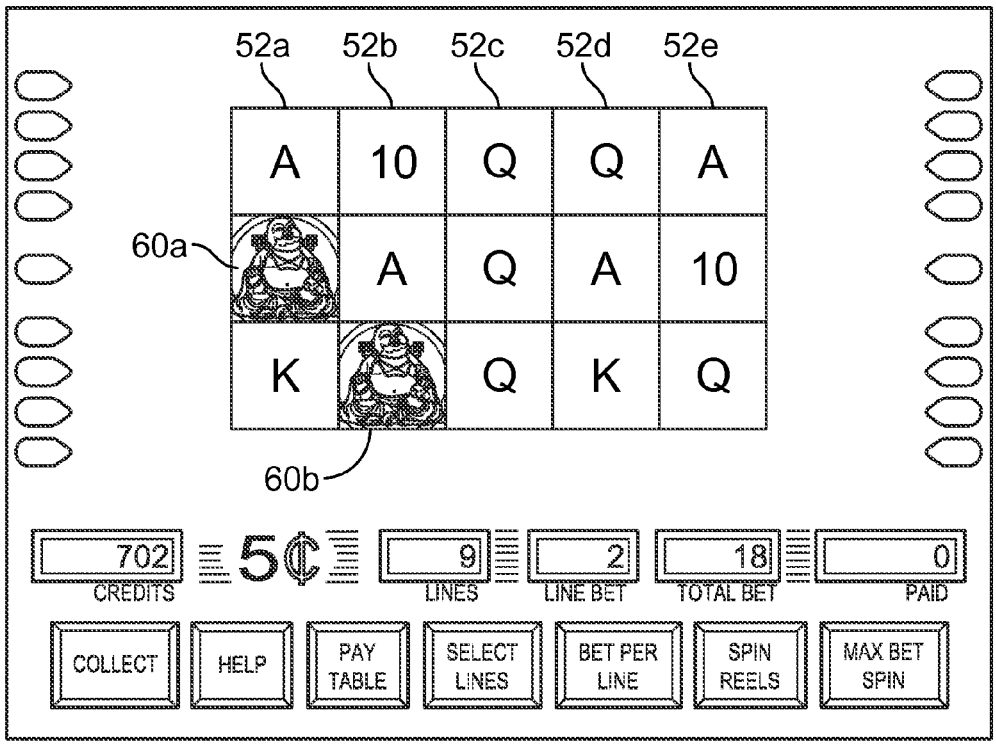
FIGS. 7A-7B are images of an exemplary game screen of a wagering game displayed on a gaming terminal, according to an embodiment of the present invention.

FIG. 7A illustrates a non-limiting example of a wagering-game screen displaying a randomly selected outcome that includes a special symbol on two adjacent reels. In particular, the randomly selected outcome includes a first special symbol 60*a* located on the first reel 52*a* and a second special symbol 60*b* located on the second reel 52*b*. In response to the randomly selected outcome including a special symbol 60*a* and 60*b* on the adjacent reels 52*a* and 52*b*, the first special symbol 60*a* and the second special symbol 60*b* are enhanced by changing the functionality of the first special symbol 60*a* and the second special symbol 60*b* from a wild-symbol function to a multiplying wild-symbol function. For example, as shown in FIG. 7B, the first special symbol 60*a* and the second special symbol 60*b* can be provided with a "2×" multiplier such that an award achieved for any winning combination of symbols including the first special symbol and/or the second special symbol is multiplied by the "2×" multiplier of the first special symbol and/or the second special symbol.

Figure 7B:
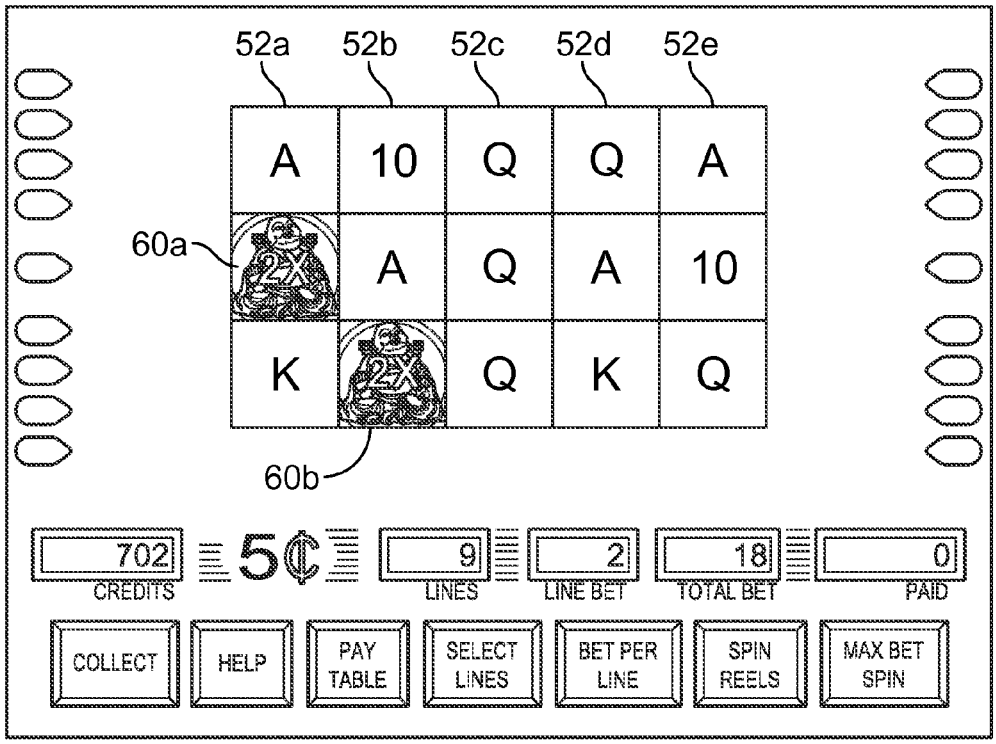

In the embodiment illustrated in FIGS. 7A-7B, the image of each special symbol 60*a* and 60*b* was modified to indicate a multiplier value in response to the enhancement of the functionality of the special symbols 60*a* and 60*b*. It is contemplated that, according to embodiments of the present concepts, the image of a special symbol can remain the same, be replaced with a different image, or be otherwise modified in response to an enhancement of the special symbol due to the special symbol being on a reel that is adjacent to another reel including another special symbol. In some embodiments, the first and second special symbols 60*a,b* may be further required to be in adjacent positions on adjacent reels before the functionality of the symbols is enhanced from the first functionality to the second functionality. Adding the requirement of adjacent positions allows for more "near miss" opportunities, which could increase player excitement for, and longevity on, a wagering game.

Figure 8A:
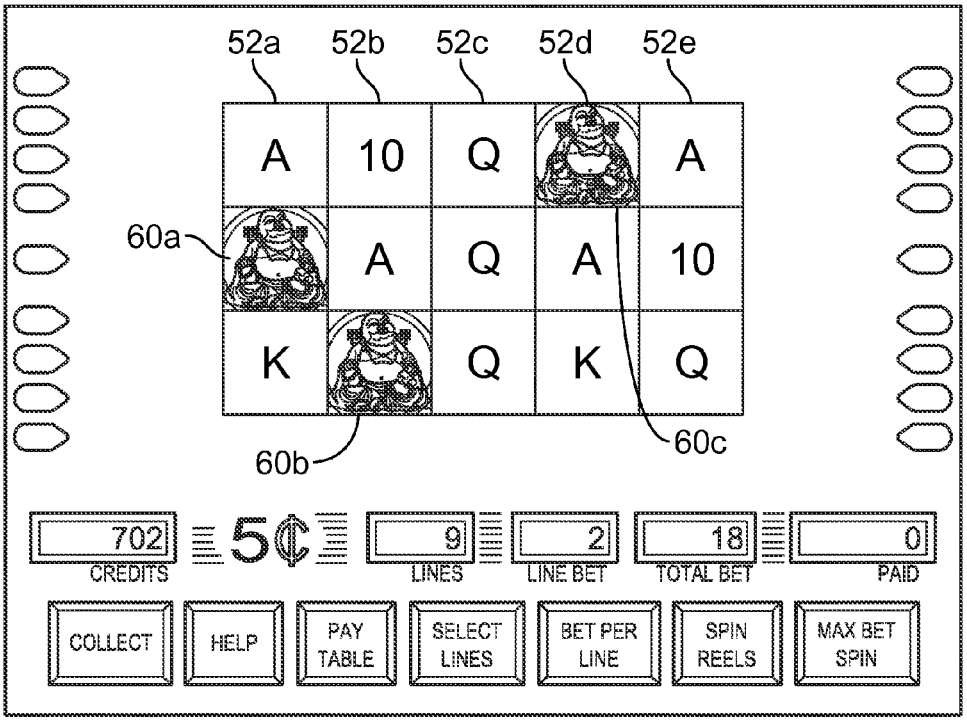
FIGS. 8A-8B are images of an exemplary game screen of a wagering game displayed on a gaming terminal, according to an embodiment of the present invention.
Figure 8B:
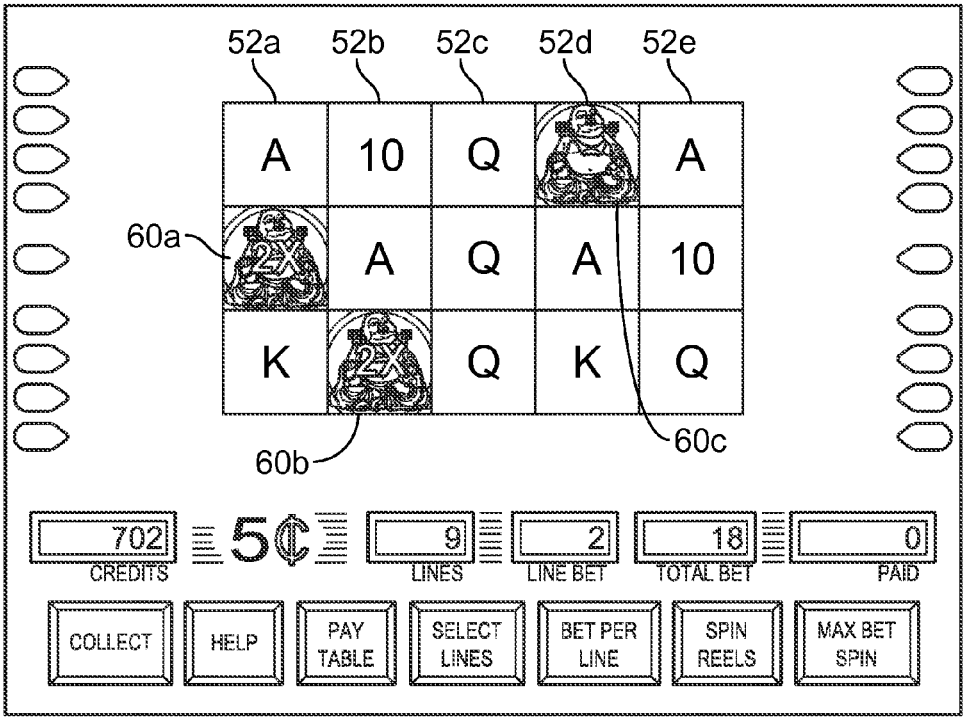

FIG. 8A illustrates a non-limiting example of a wagering-game screen displaying a randomly selected outcome that includes a special symbol on two adjacent reels and a special symbol on a non-adjacent reel. In particular, the randomly selected outcome includes a first special symbol 60*a* located on the first reel 52*a*, a second special symbol 60*b* located on the second reel 52*b*, and a third special symbol 60*c* located on the fourth reel 52*d*. In response, the first special symbol 60*a* and the second special symbol 60*b*, which are located on the adjacent reels 52*a* and 52*b*, are enhanced while the third special symbol 60*c*, which is located on the non-adjacent reel 52*d*, is not enhanced. For example, as shown in FIG. 8B, the first special symbol 60*a* and the second special symbol 60*b* can be provided with a "2×" multiplier such that an award achieved for any winning combination of symbols including the first special symbol 60*a* and/or the second special symbol 60*b* is multiplied by the "2×" multiplier of the first special symbol 60*a* and/or the second special symbol 60*b*. Also shown in FIG. 8B, the third special symbol 60*c* is not provided with a multiplier and, thus, the third special symbol 60*c* provides the wild-symbol function without a multiplier. As a result, a determination of whether the randomly selected outcome includes a winning combination of symbols (e.g., along an active payline) and a determination of an award amount associated with any such winning combination are based on the first special symbol 60*a* and the second special symbol 60*b* providing a multiplying wild-symbol function and the third special symbol 60*c* providing a wild-symbol function without a multiplier.

Figure 9A:
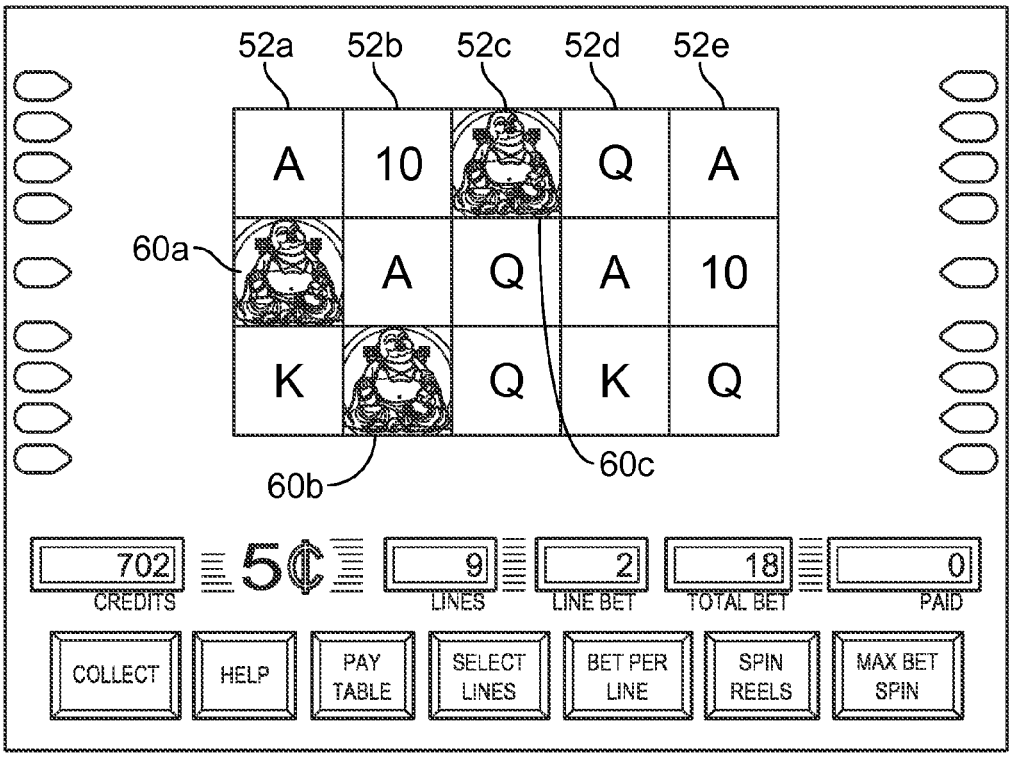
FIGS. 9A-9B are images of an exemplary game screen of a wagering game displayed on a gaming terminal, according to an embodiment of the present invention.

FIG. 9A illustrates a non-limiting example of a wagering-game screen displaying a randomly selected outcome that includes a special symbol located on three adjacent reels. In particular, the randomly selected outcome includes a first special symbol 60*a* located on the first reel 52*a*, a second special symbol 60*b* located on the second reel 52*b*, and a third special symbol 60*c* located on the third reel 52*c*. In response to the randomly selected outcome including the special symbols 60*a-c* on the adjacent reels 52*a-c*, the first special symbol 60*a*, the second special symbol 60*b* and the third special symbol 60*c* are enhanced by changing the functionality of the first special symbol 60*a*, the second special symbol 60*b*, and the third special symbol 60*c* from a wild-symbol function to a multiplying wild-symbol function.

Figure 9B:
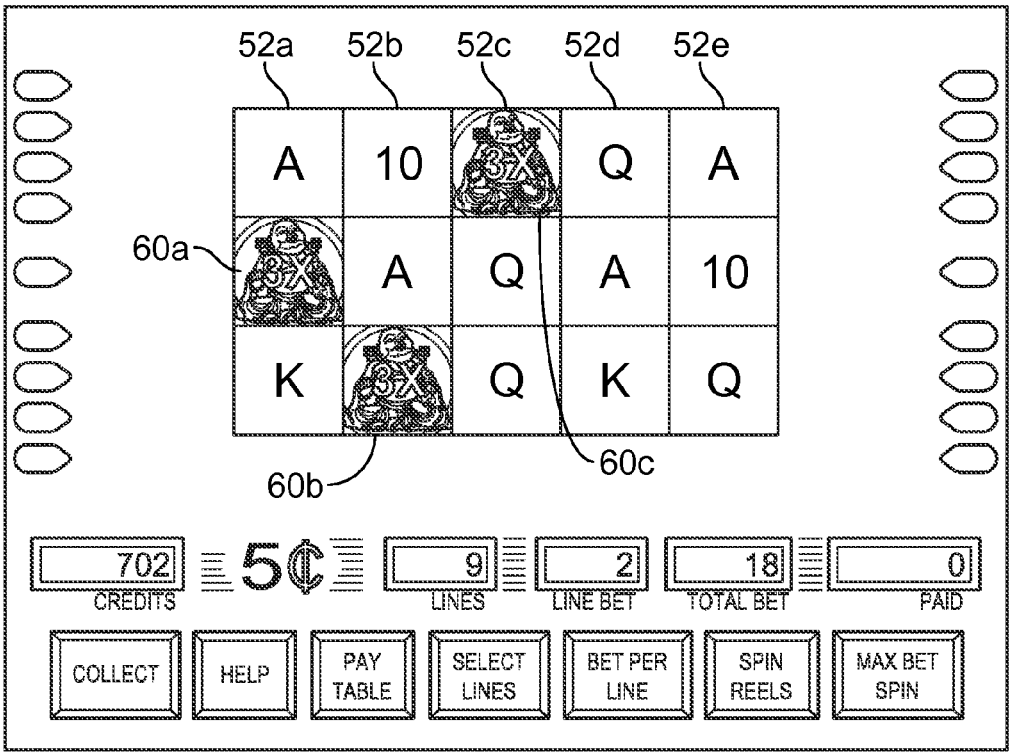

According to some embodiments, the enhancement can be based on the number of adjacent reels that include a special symbol. For example, the value of the multiplier provided by the special symbol can be based on the number of adjacent reels that include a special symbol (e.g., a "2×" multiplier can be provided when the special symbol is located on two adjacent reels, a "3×" multiplier can be provided when the special symbol is located on three adjacent reels, a "4×" multiplier can be provided when the special symbol is located on four adjacent reels, and so on). As shown in FIG. 9B, the first special symbol 60*a*, the second special symbol 60*b*, and the third special symbol 60*c* are provided with a "3×" multiplier such that an award achieved for any winning combination of symbols including the first special symbol 60*a*, the second special symbol 60*b*, and/or the third special symbol 60*c* is multiplied by the "3×" multiplier of the first special symbol 60*a*, the second special symbol 60*b*, and/or the third special symbol 60*c*. As another example, in embodiments in which a special symbol is enhanced by an expanding functionality, the number of symbol positions that a special symbol is expanded to can be based on the number of adjacent reels that include a special symbol (e.g., special symbols on two adjacent reels causes the special symbols to expand one symbol position, three adjacent reels causes the special symbol to expand two symbol positions, etc.).

It is contemplated that, according to other embodiments, the enhancement can be based on the number of special symbols that are located on adjacent reels for the randomly selected outcome. For example, a randomly selected outcome including three special symbols on two adjacent reels can be enhanced with a "3×" multiplier, a randomly selected outcome including four special symbols on two adjacent reels can be enhanced with a "4×" multiplier, a randomly selected outcome including four special symbols on three adjacent reels can be enhanced with a "4×" multiplier, and so on.

It is further contemplated that, according to still other embodiments, the same enhancement can be provided for the special symbols on adjacent reels regardless of the number of special symbols on adjacent reels or the number of adjacent reels on which the special symbols are located (as long as the special symbols are located on at least two adjacent reels). For example, the special symbols can each be provided with a randomly determined multiplier or the same fixed multiplier regardless of the number of special symbols or the number of adjacent reels on which the special symbols are located.

It is also contemplated that, according to further embodiments, the type of enhancement provided for the special symbols can be based on the number of special symbols on adjacent reels and/or the number of adjacent reels that include a special symbol. For example, the special symbols can provide a multiplier wild-symbol function when the randomly selected outcome includes a special symbol on two adjacent reels, an expanding wild-symbol function when the randomly selected outcome includes a special symbol on three adjacent reels, and an expanding and multiplying wild-symbol function when the randomly selected outcome includes a special symbol on four adjacent symbols.

Figure 10A:
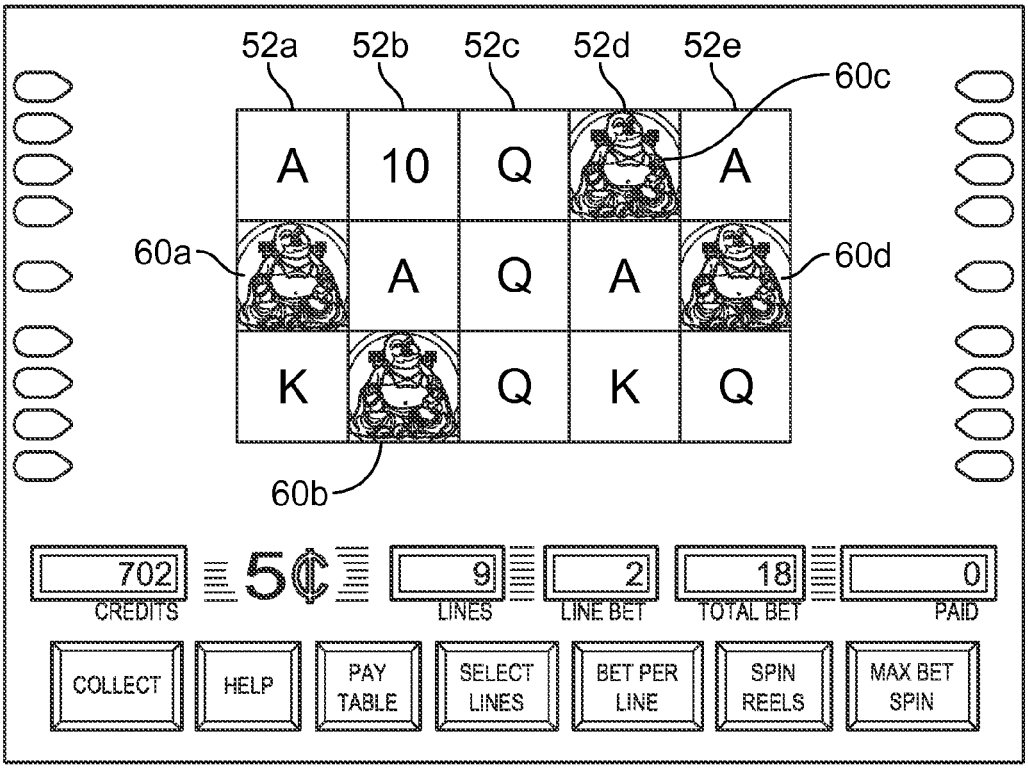
FIGS. 10A-10B are images of an exemplary game screen of a wagering game displayed on a gaming terminal, according to an embodiment of the present invention.
Figure 10B:
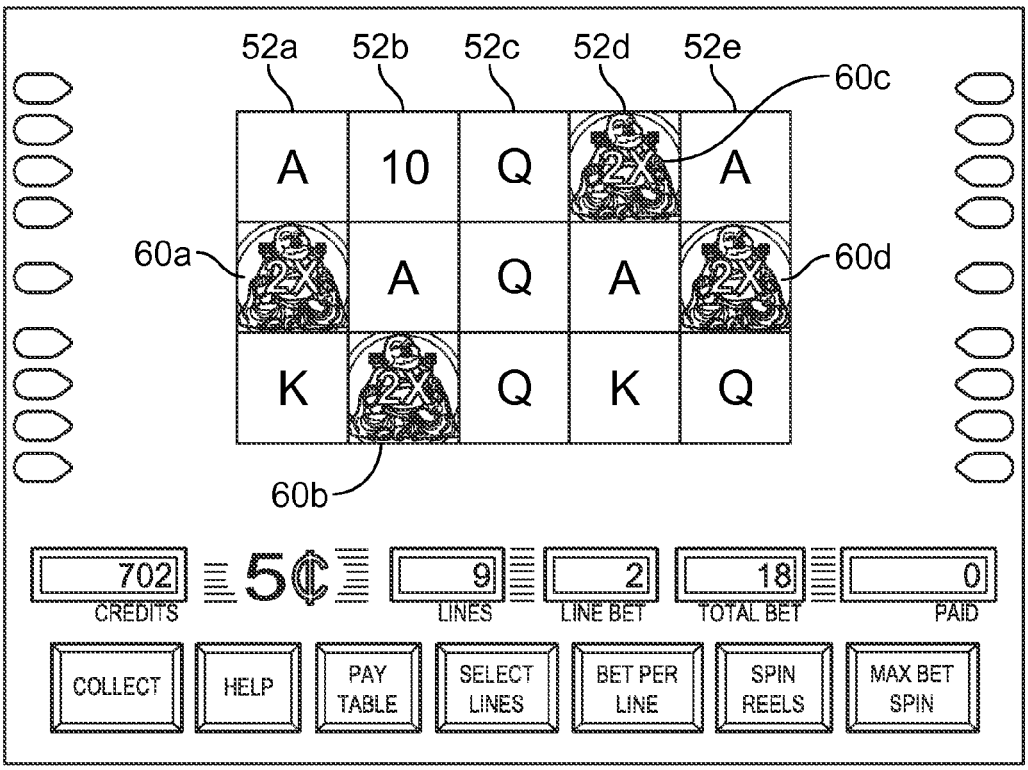

FIGS. 10A-10B further illustrate an exemplary embodiment in which the second functionality of the special symbol is based on the number of adjacent reels including a special symbol. FIG. 10A shows a non-limiting example of a wagering-game screen displaying a randomly selected outcome that includes a special symbol on four reels. In particular, the randomly selected outcome includes a first special symbol 60*a* located on the first reel 52*a*, a second special symbol 60*b* located on the second reel 52*b*, a third special symbol 60*c* located on the fourth reel 52*d*, and a fourth special symbol 60*d* located on the fifth reel 52*e*. As each special symbol is adjacent to only one other special symbol, the special symbols 60*a-d* are provided with a second functionality that is based on the number of adjacent reels being one. For example, as shown in FIG. 10B, the first special symbol 60*a*, the second special symbol 60*b*, the third special symbol 60*c*, and the fourth special symbol 60*d* are enhanced with a "2×" multiplier as opposed to a "4×" multiplier.

FIGS. 11A-12B illustrate non-limiting examples of wagering-game screens for a wagering game having an adjacent-reel functionality enhancement in which the special symbol provides a first functionality when the randomly selected outcome includes a special symbol on only one reel or on non-adjacent reels and an expanding second functionality when the randomly selected outcome includes a special symbol on adjacent reels.

Figure 11A:
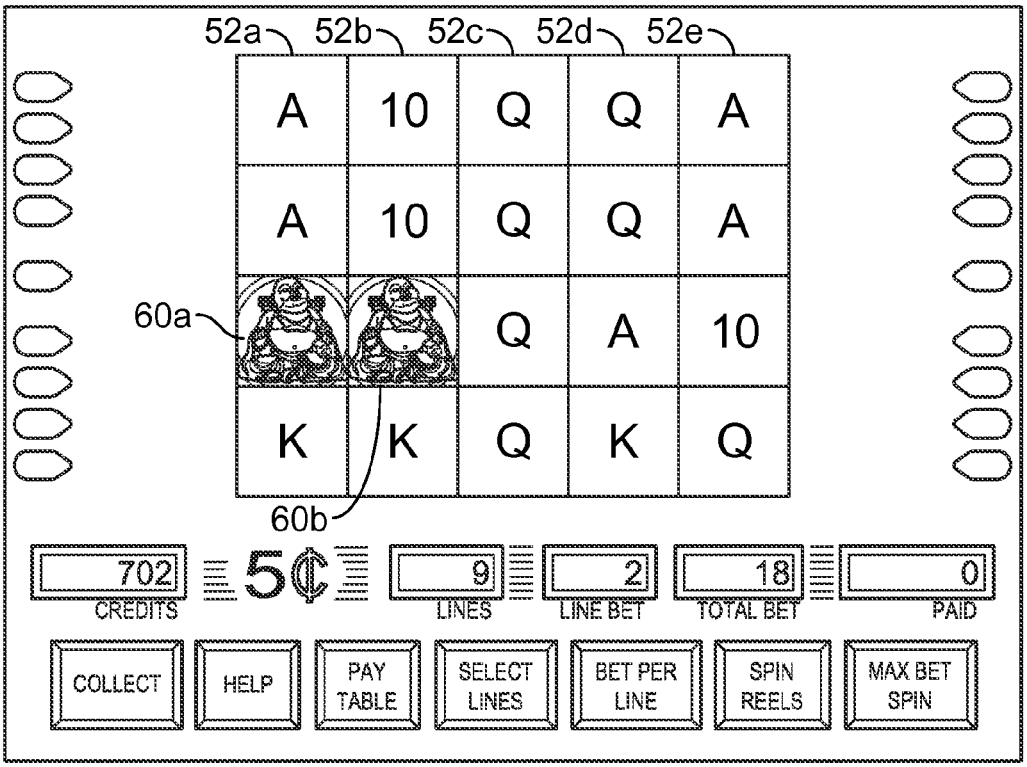
FIG. 11A-11B are images of an exemplary game screen of a wagering game displayed on a gaming terminal, according to an embodiment of the present invention.
Figure 11B:
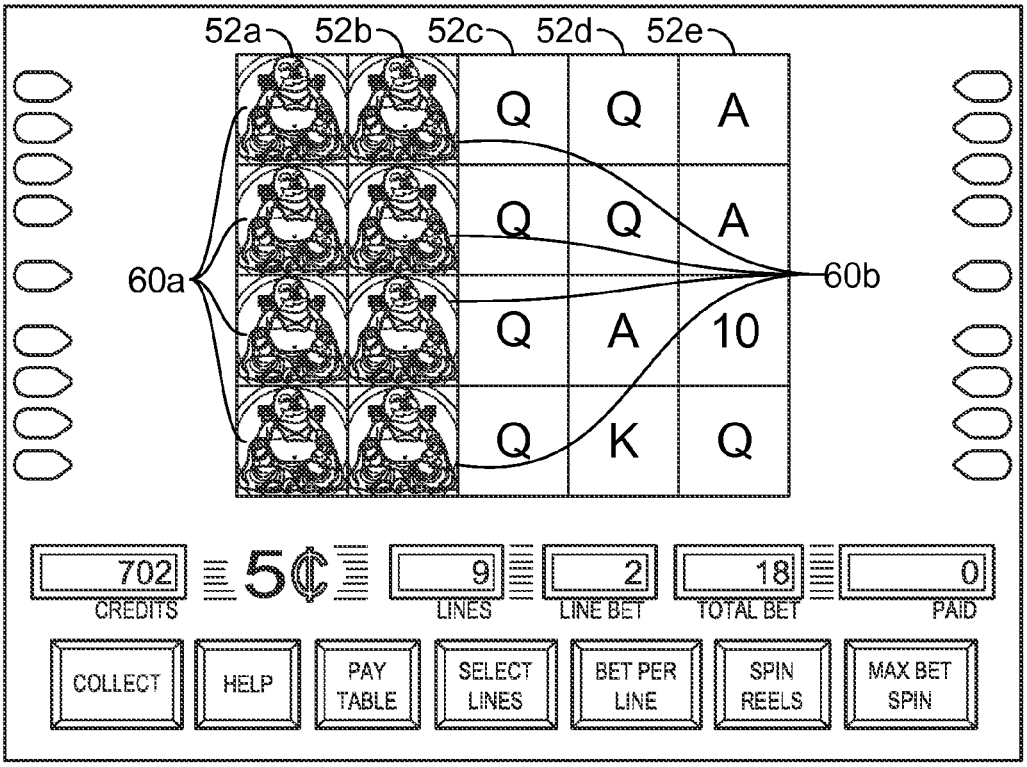

According to some embodiments, when a randomly selected outcome includes a special symbol on two or more adjacent reels, the special symbol expands vertically into all symbol positions of the adjacent reels. For example, FIG. 11A illustrates a non-limiting example of a wagering-game screen displaying a randomly selected outcome that includes special symbols 60*a* and 60*b* on two adjacent reels 52*a* and 52*b*. As shown in FIG. 11B, in response to the randomly selected outcome including the special symbols 60*a* and 60*b* on the adjacent reels 52*a* and 52*b*, the first special symbol 60*a* and the second special symbol 60*b* are enhanced by expanding the special symbols 60*a* and 60*b* to all symbol positions on the adjacent reels 52*a* and 52*b*.

Figure 12A:
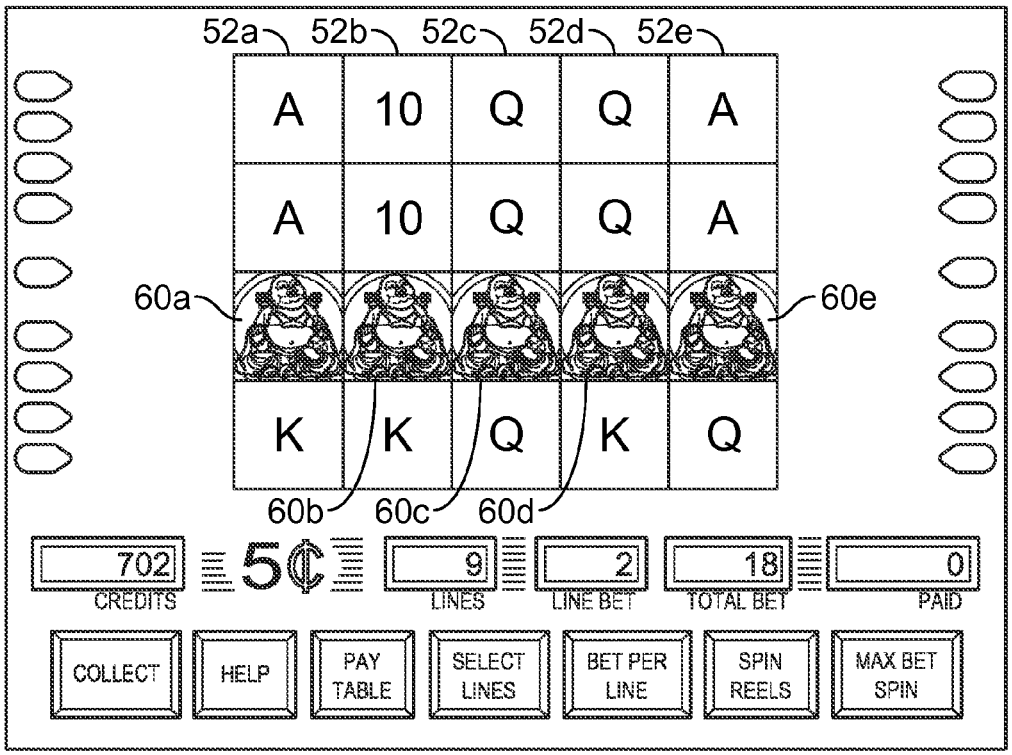
FIGS. 12A-12B are images of an exemplary game screen of a wagering game displayed on a gaming terminal, according to an embodiment of the present invention.
Figure 12B:
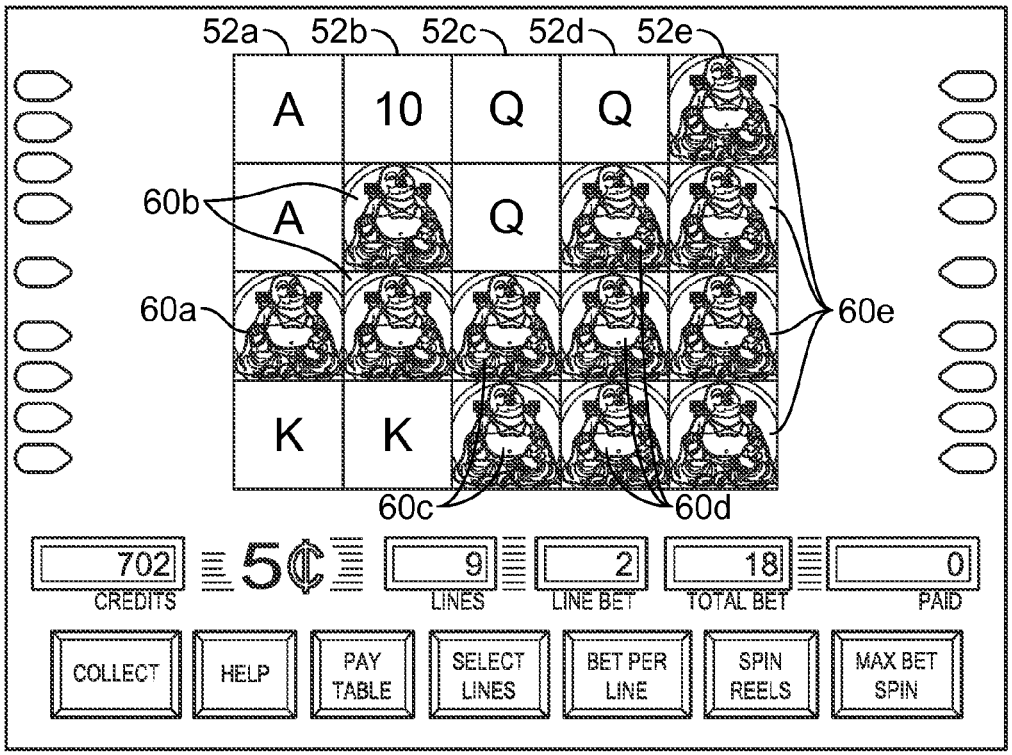

According to other embodiments, when a randomly selected outcome includes a special symbol on two or more adjacent reels, a determination can be made as to whether to expand the special symbols, which direction(s) relative to the position of a special symbol in the array to expand the special symbols, and how many symbol positions to expand the special symbols. For example, FIG. 12A illustrates a non-limiting example of a wagering-game screen displaying a randomly selected outcome that includes a special symbol 60*a-e* on each of the five reels 52*a*-52*e*. As shown in FIG. 12B, the first special symbol 60*a* located on the first reel 52*a* is not expanded, the second special symbol 60*b* located on the second reel 52*b* is expanded one symbol position in a upwardly vertical direction, the third special symbol 60*c* located on the third reel 52*c* is expanded one symbol position in a downwardly vertical direction, the fourth special symbol 60*d* located on the fourth reel 52*d* is expanded one symbol position in an upwardly vertical direction and one symbol position in a downwardly vertical direction, and the fifth special symbol 60*e* located on the fifth reel 52*e* is expanded two symbol positions in an upwardly vertical direction and one symbol position in a downwardly vertical direction.

Figure 13:
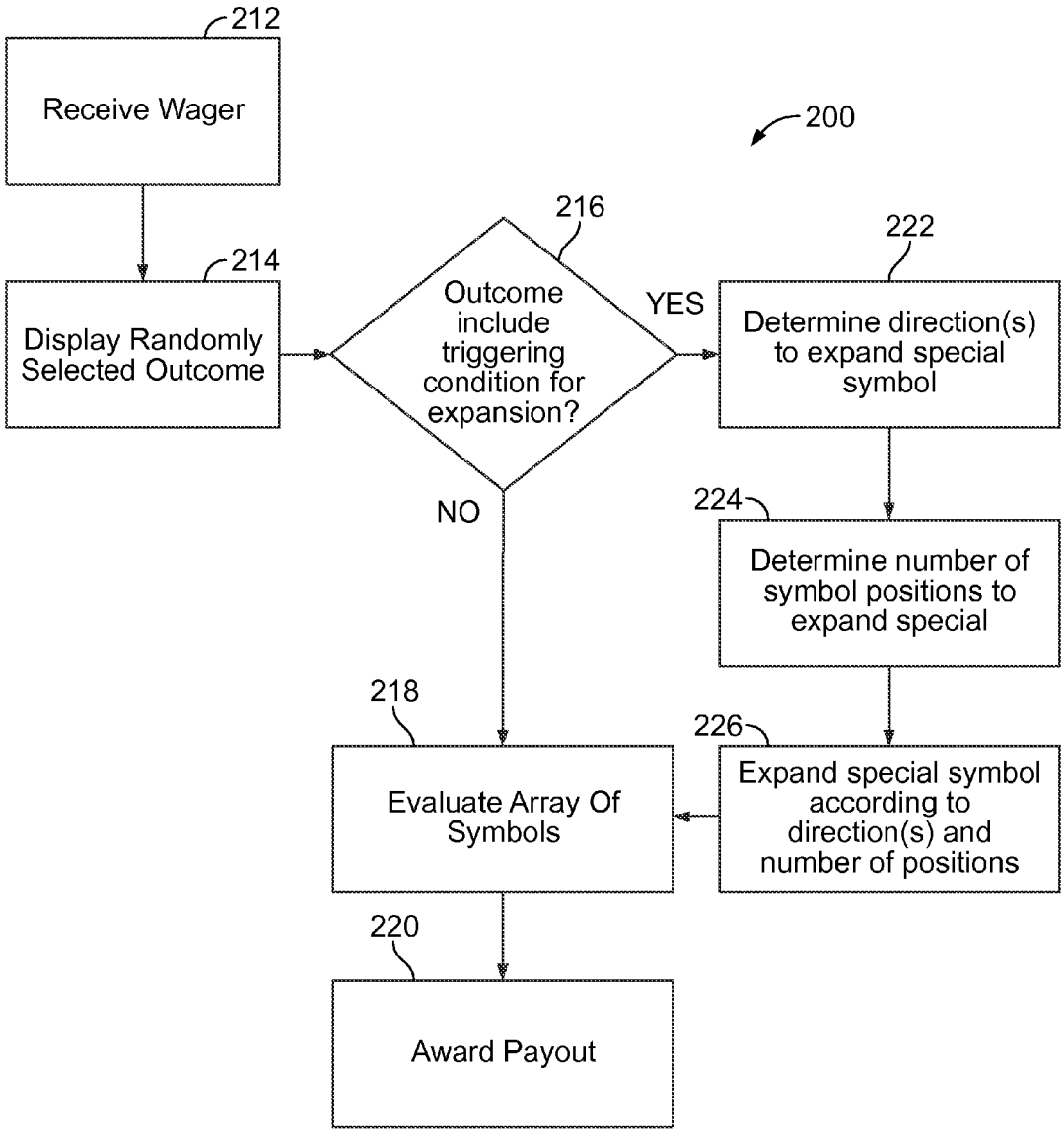
FIG. 13 is a flowchart for an algorithm that corresponds to instructions executed by a controller in accord with at least some aspects of the disclosed concepts.

The above described expansion of a special symbol also can be provided for a wagering game that does not include an adjacent-reel enhancement feature. For example, FIG. 13 illustrates a non-limiting example of a flowchart of an algorithm 200 for determining an expansion of a special symbol, which can be employed in connection with or independently of an adjacent-reel enhancement feature. At block 212, a wager is received in response to an input provided by a player on an input device of a gaming machine. At block 214, a randomly selected outcome of the wagering game is displayed in a display area (e.g., the primary display area 12 and/or the secondary display area 14) of a display device. At decision block 216, the CPU determines whether the randomly selected outcome includes a triggering condition for potentially expanding a special symbol (e.g., a randomly selected outcome including a special symbol on adjacent reels or a randomly selected outcome including a special symbol that can expand regardless of any other symbol on an adjacent reel). If it is determined at block 216 that the randomly selected outcome does not include a triggering condition, then at block 218 the array of symbols displayed on the reels is evaluated to determine whether the array includes any winning combinations. Then, at block 220, an award payout is provided for any winning combinations determined at block 218.

If it is determined at block 216 that the randomly selected outcome includes a triggering condition, then at block 222 the CPU determines for each of the at least one special symbol one or more directions (relative to the position of respective special symbol in the array) to expand. Then, at block 224, the CPU determines for each of the at least one special symbol a number of symbol positions to expand in each of the one or more directions. The number of symbol positions can range from zero symbol positions to a number of symbol positions sufficient to expand the special symbol to all symbol positions on a reel. At block 226, each special symbol is expanded according to the direction(s) and the respective number of symbol positions determined at block 222 and block 224. Next, at block 218, the array of symbols is evaluated to determine whether the array includes any winning combinations. Then, at block 220, an award payout is provided for any winning combinations determined at block 218.

According to some embodiments of the present concepts, when two or more special symbols are located in adjacent symbol positions on the same reel or on adjacent reels, the image of each individual special symbol can be replaced with a single, unified image covering all of the adjacent symbol positions of the two or more special symbols. Exemplary embodiments in which the images of adjacent symbol positions are replaced with a single, unified image covering the adjacent symbol positions are shown in FIGS. 14A-17B. In the exemplary embodiments illustrated in FIGS. 14A-17B, the special symbol provides an expanding wild-symbol functionality when the randomly selected outcome includes a special symbol on only one reel or on non-adjacent reels and an expanding multiplier wild-symbol functionality when the randomly selected outcome includes a special symbol on adjacent reels. However, it is contemplated that a single, unified image can be provided for any other suitable functionality.

Figure 14A:
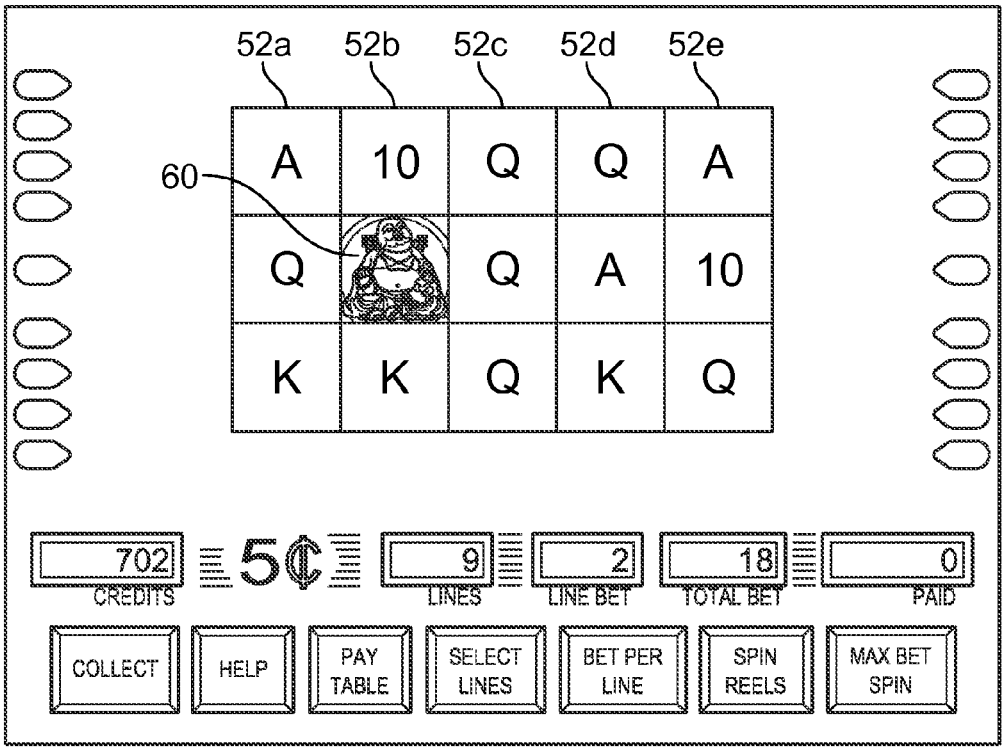
FIGS. 14A-14B are images of an exemplary game screen of a wagering game displayed on a gaming terminal, according to an embodiment of the present invention.
Figure 14B:
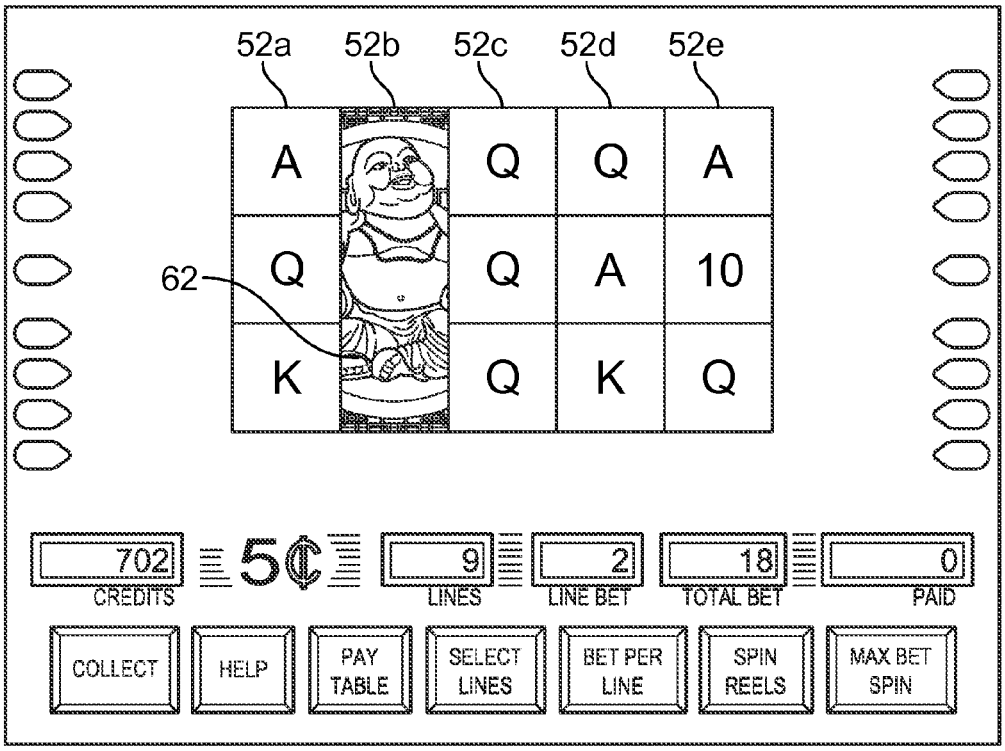

FIG. 14A illustrates a non-limiting example of a wagering-game screen displaying a randomly selected outcome that includes a special symbol 60 located on only one reel 52*b*. As the randomly selected outcome does not include a special symbol on an adjacent reel (e.g., the reel 52*a* or the reel 52*c*), the special symbol 60 provides an expanding wild-symbol function. As shown in FIG. 14B, a single, unified image 62 replaces each of the images on the symbol positions of the expanded wild-symbols.

Figure 15A:
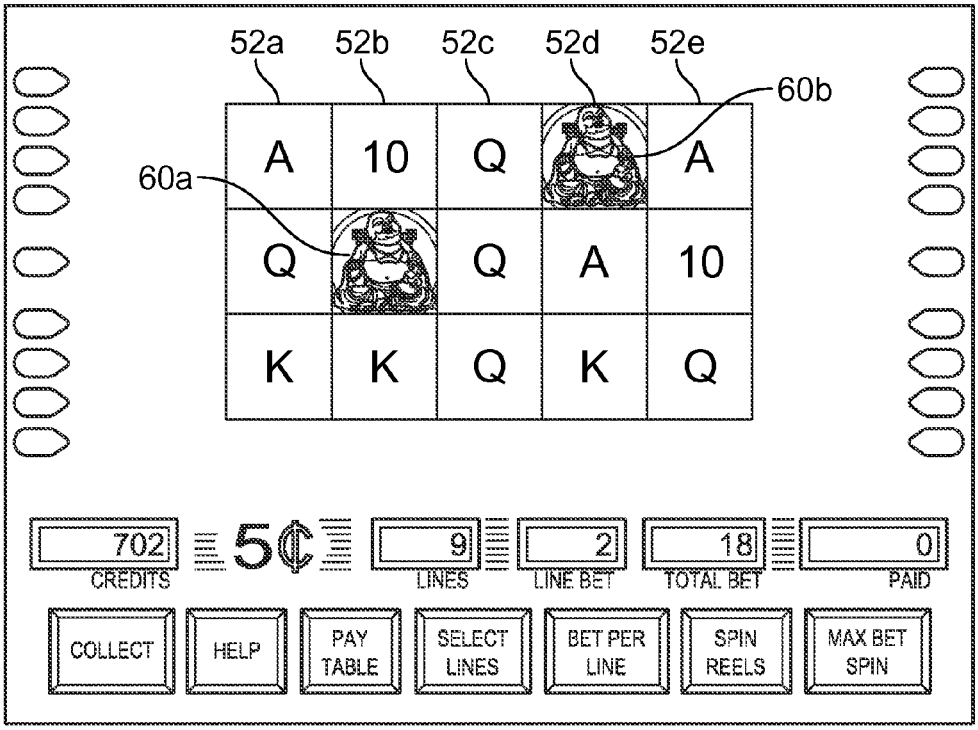
FIGS. 15A-15B are images of an exemplary game screen of a wagering game displayed on a gaming terminal, according to an embodiment of the present invention.
Figure 15B:
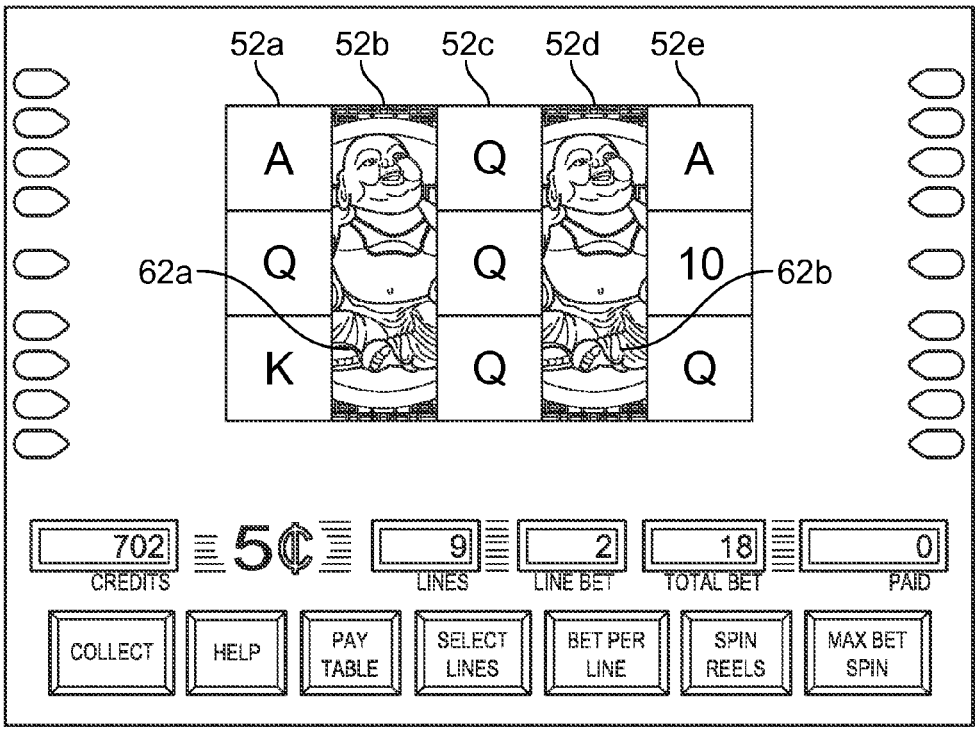

FIG. 15A illustrates a non-limiting example of a wagering-game screen displaying a randomly selected outcome that includes special symbols 60*a* and 60*b* located on non-adjacent reels 52*b* and 52*d*. Accordingly, the special symbols 60*a* and 60*b* each provide an expanding wild-symbol function. As shown in FIG. 15B, a single, unified image 62*a* replaces each of the images on the symbol positions of the expanded wild-symbols on the reel 52*b* and another single, unified image 62*b* replaces each of the images of the symbol positions of the expanded wild-symbols located on the reel 52*d*.

Figure 16A:
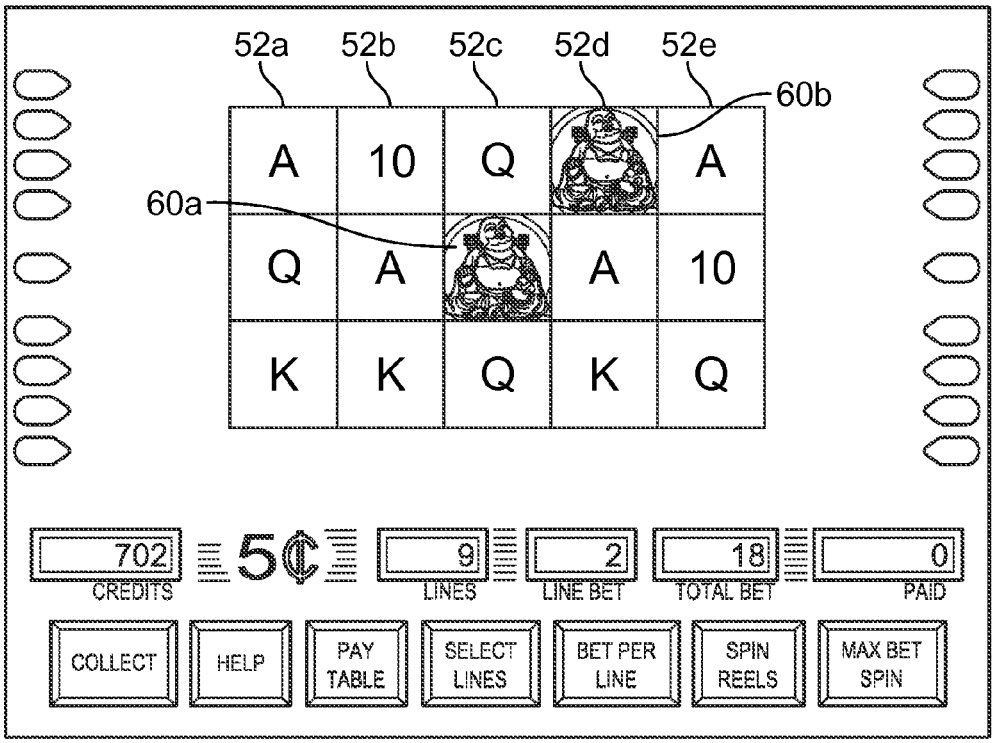
FIGS. 16A-16B are images of an exemplary game screen of a wagering game displayed on a gaming terminal, according to an embodiment of the present invention.
Figure 16B:
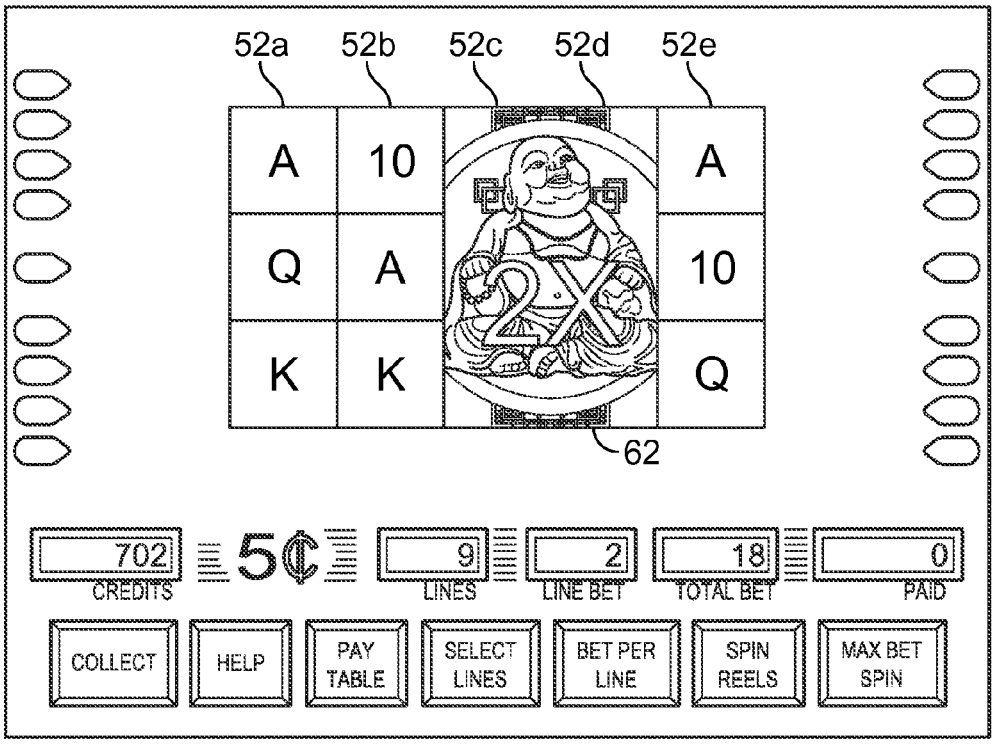

FIG. 16A illustrates a non-limiting example of a wagering-game screen displaying a randomly selected outcome that includes special symbols 60*a* and 60*b* located on adjacent reels 52*c* and 52*d*. Accordingly, the special symbols 60*a* and 60*b* provide an expanding and multiplying wild-symbol function. As shown in FIG. 16B, a single, unified image 62 replaces each of the images on the symbol positions of the expanded wild-symbols on the reel 52*b* and the reel 52*d*. In other words, the single, unified image 62 covers both of the adjacent reels 52*c* and 52*d*.

Figure 17A:
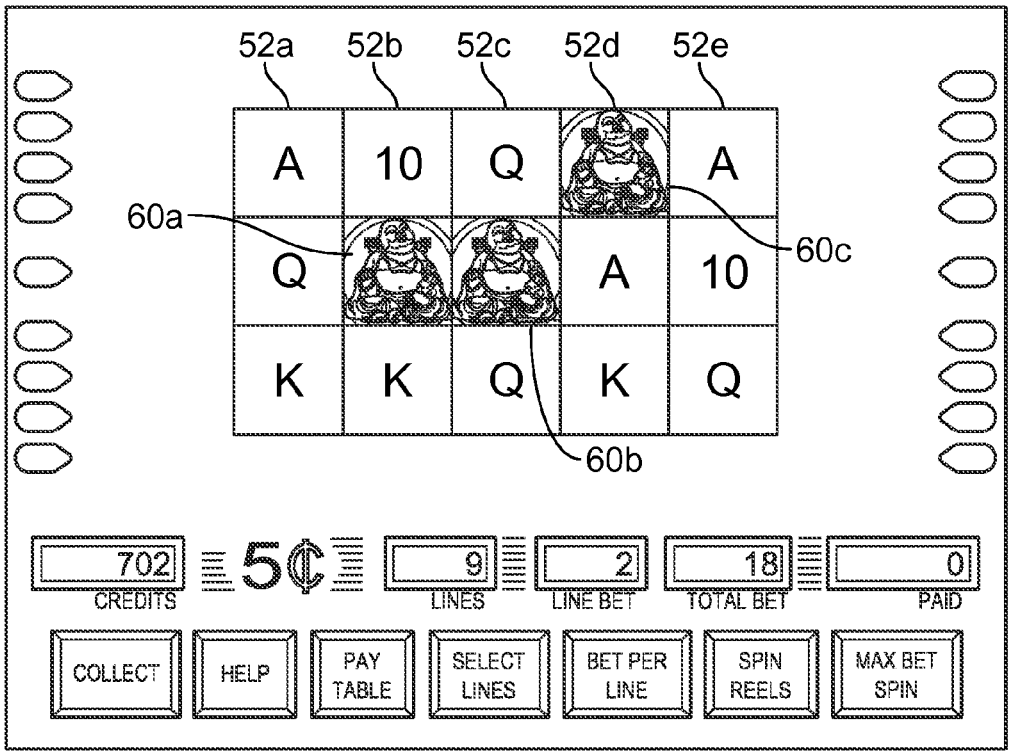
FIGS. 17A-17B are images of an exemplary game screen of a wagering game displayed on a gaming terminal, according to an embodiment of the present invention.
Figure 17B:
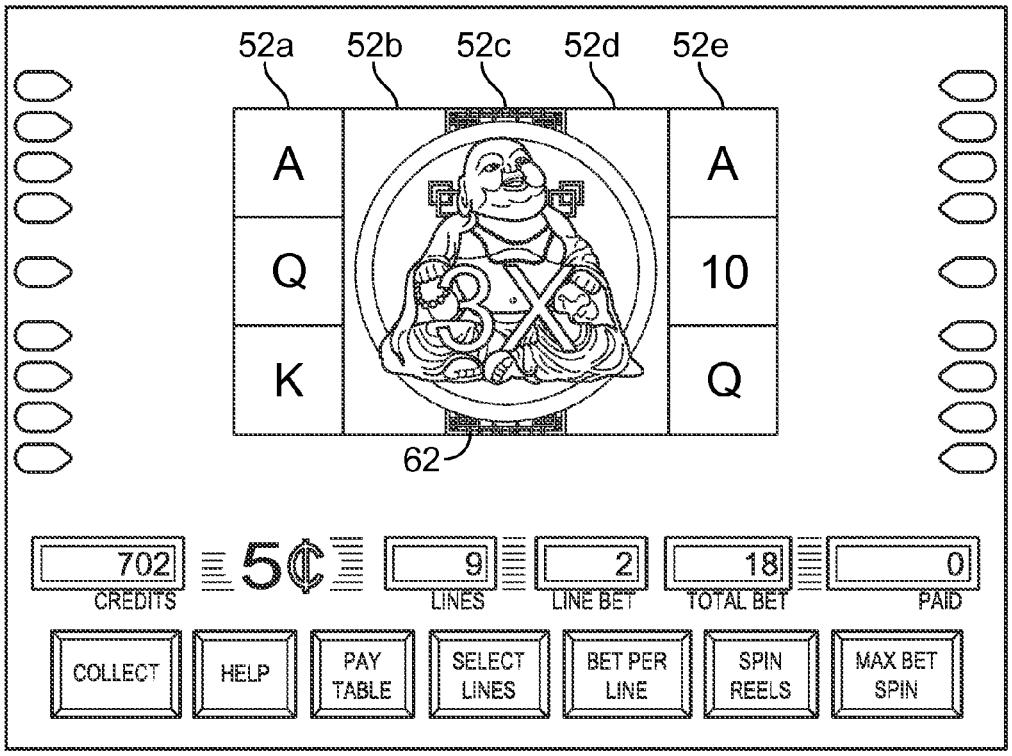

FIG. 17A illustrates a non-limiting example of a wagering-game screen displaying a randomly selected outcome that includes special symbols 60*a*, 60*b* and 60*c* located on adjacent reels 52*c* and 52*d*. Accordingly, the special symbols provide an expanding and multiplying wild-symbol function. As shown in FIG. 17B, a single, unified image 62 replaces each of the images on the symbol positions of the expanded wild-symbols on the reel 52*b* and the reel 52*d*.

While the single, unified image is shown covering all symbol positions on each reel including a special symbol in the exemplary embodiments of FIGS. 14A-17B, it is contemplated that, in other embodiments, a single, unified image can be provided for special symbols that expand to fewer than all symbol positions on each reel. For example, it is contemplated that the special symbols shown in FIG. 12B can be replaced by a single, unified image.

Additionally, while the single, unified image is provided for expanded special symbols on non-adjacent reels in FIGS. 14B and 15B, it is contemplated that, according to some embodiments, a single, unified image may be provided only in connection with a second functionality for special symbols located on adjacent reels.

According to some embodiments of the present concepts, when two or more special symbols are located on adjacent reels, the image of each individual special symbol can be replaced with a portion of a unified image, covering all of the adjacent symbol positions. Exemplary embodiments, in which the images of adjacent symbol positions are replaced with a portion of a unified image are shown in FIGS. 18*a*-20*b*. In the exemplary embodiments illustrated in FIGS. 18*a*-20*b*, the special symbol provides an expanding wild-symbol functionality when the randomly selected outcome includes a special symbol on only one reel or on non-adjacent reels and an expanding multiplier wild-symbol functionality when the randomly selected outcome includes a special symbol on adjacent reels. However, it is contemplated that a portion of a unified image can be provided for any other suitable functionality.

Figure 18A:
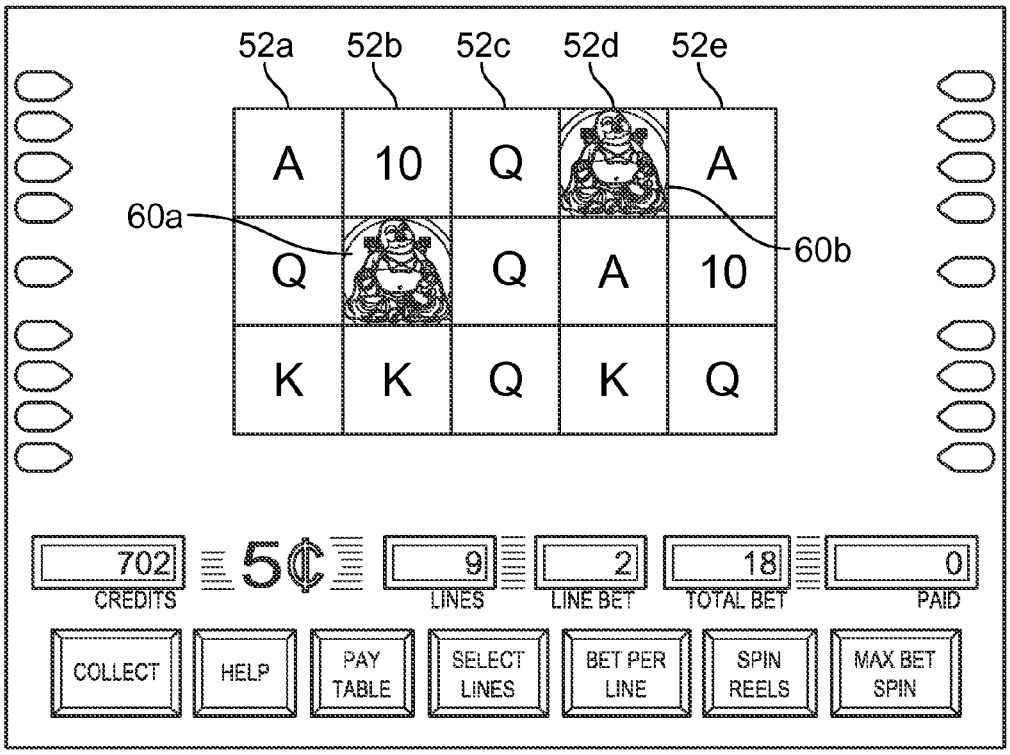
FIGS. 18A-18B are images of an exemplary game screen of a wagering game displayed on a gaming terminal, according to an embodiment of the present invention.
Figure 18B:
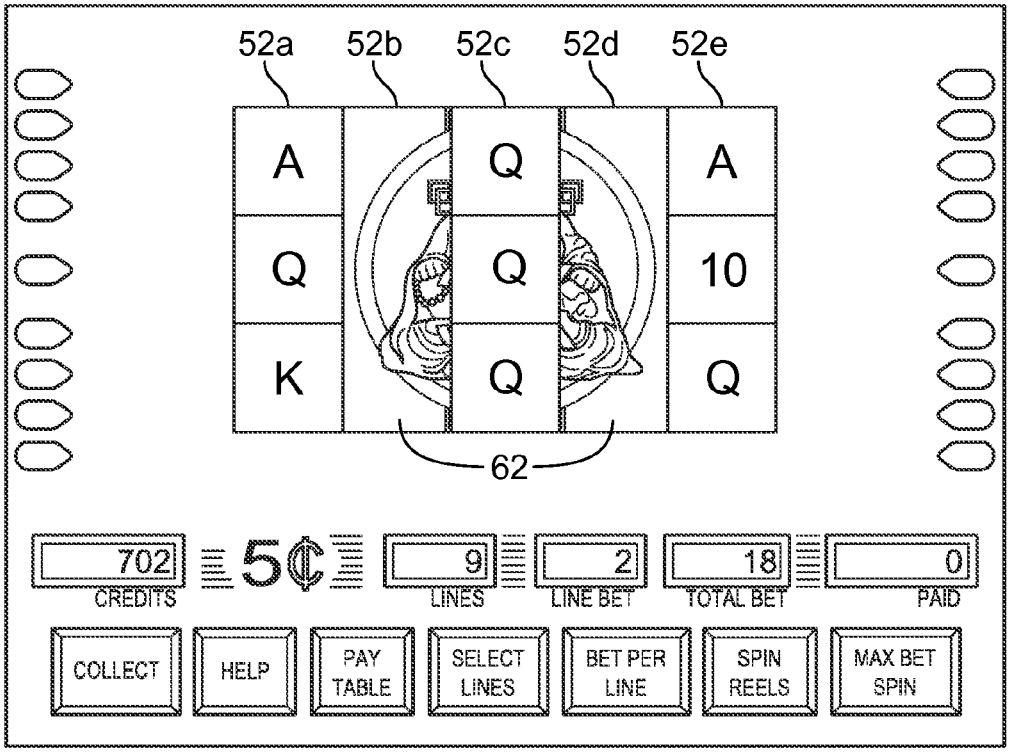

FIG. 18*a* illustrates a non-limiting example of a wagering-game screen displaying a randomly selected outcome that includes special symbols 60*a* and 60*b* located on non-adjacent reels 52*b* and 52*d*. Accordingly, the special symbols 60*a* and 60*b* provide an expanding wild-symbol functionality, as shown in FIG. 18*b*. As illustrated in FIG. 18*b*, two distinct columns of a single, unified image 62 can be seen. In one embodiment, the single, unified image 62 (best illustrated in FIG. 20*b*) can be fully displayed across reels 52*b*, 52*c*, and 52*d* when an expansion occurs on all three reels. However, when an expansion occurs on only one or two of the reels, only that portion of the single, unified image 62 which is contained on that reel is displayed. In this manner, a player can gain an understanding that there is a valuable feature available as they are only seeing a portion of what they recognize to be a larger, and more valuable, image.

Figure 19A:
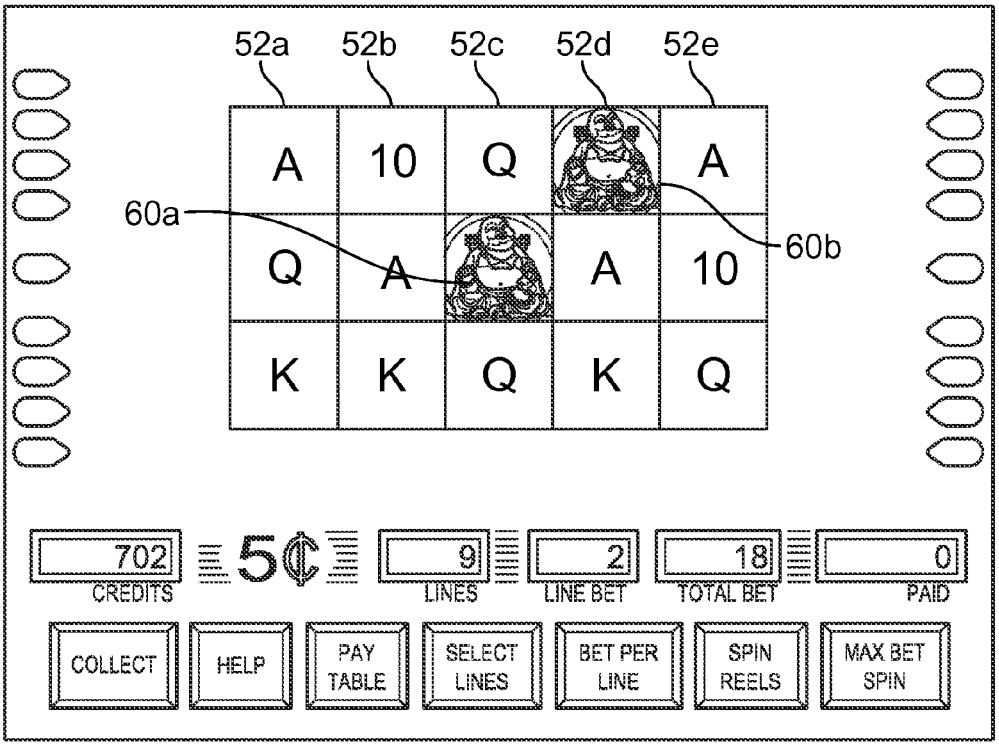
FIGS. 19A-19B are images of an exemplary game screen of a wagering game displayed on a gaming terminal, according to an embodiment of the present invention.
Figure 19B:
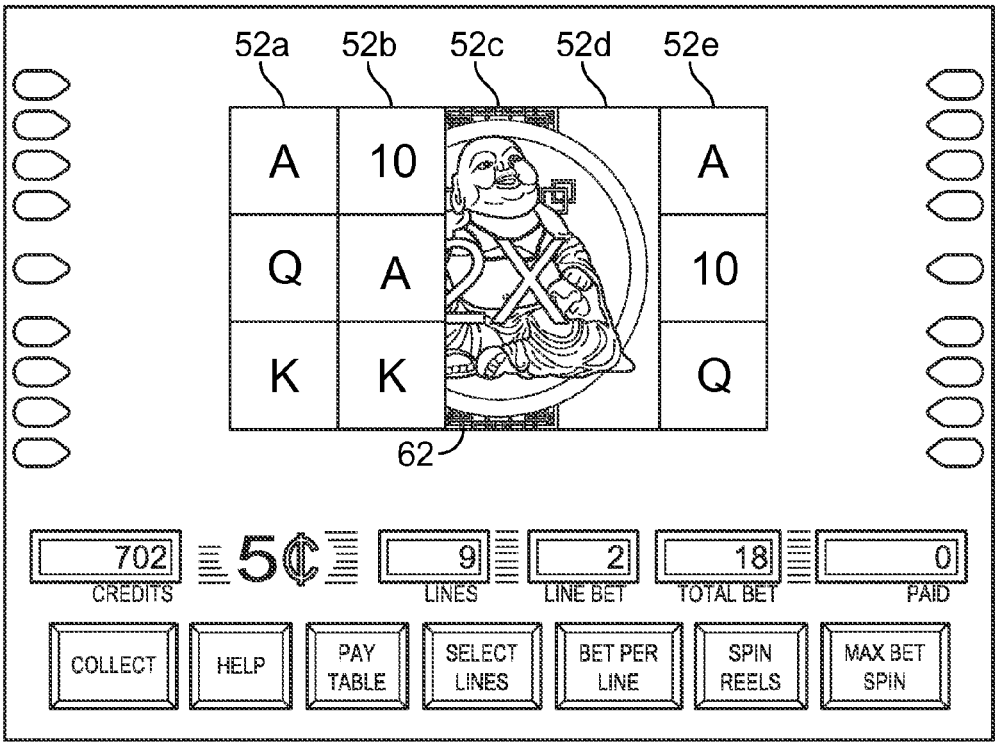

FIG. 19*a* illustrates a non-limiting example of a wagering-game screen displaying a randomly selected outcome that includes special symbols 60*a* and 60*b* located on adjacent reels 52*c* and 52*d*. Accordingly, the special symbols 60*a* and 60*b* provide a multiplying wild-symbol functionality, as shown in FIG. 19*b*. As illustrated in FIG. 19*b*, two distinct columns of a single, unified image 62 can be seen on reels 52*c* and 52*d*, and a multiplier of 2× is provided as enhanced functionality. In this illustration, the two-thirds of the single, unified image 62 is displayed to the player.

Figure 20A:
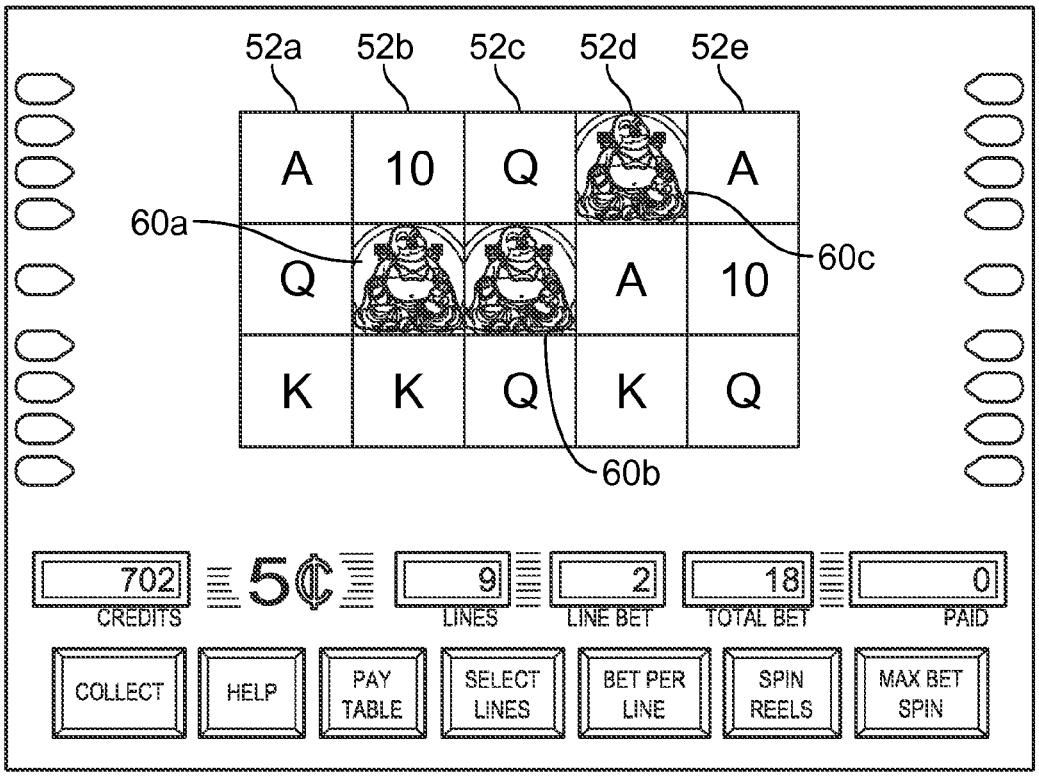
FIGS. 20A-20B are images of an exemplary game screen of a wagering game displayed on a gaming terminal, according to an embodiment of the present invention.
Figure 20B:
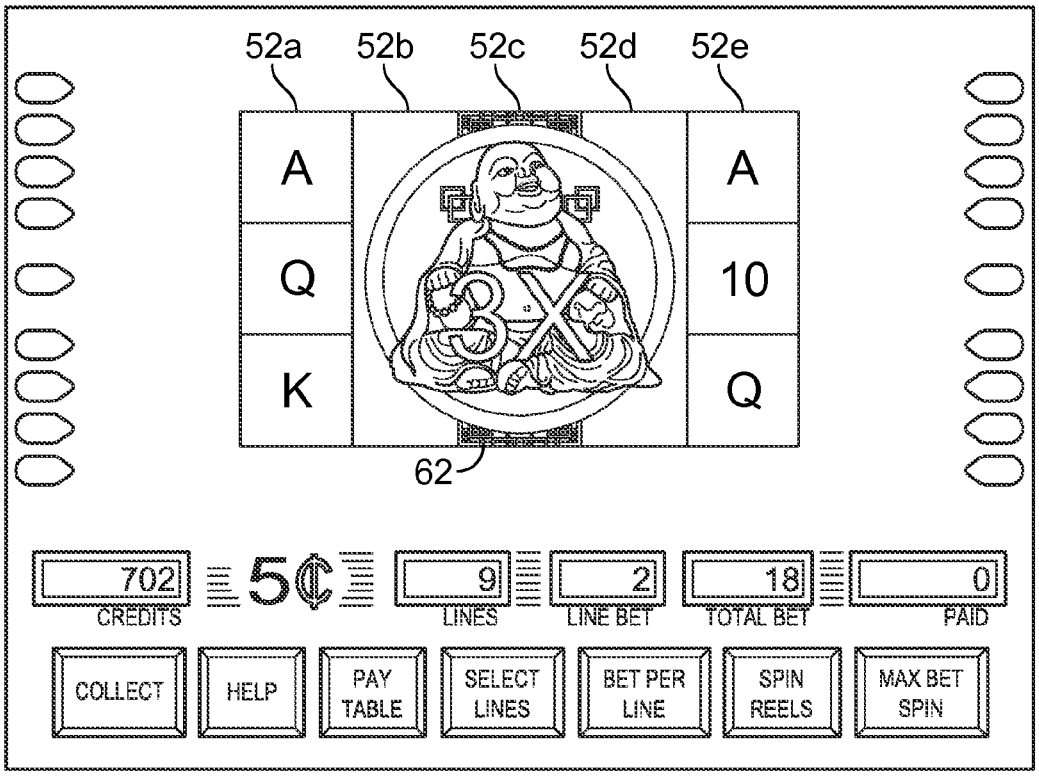

FIG. 20*a* illustrates a non-limiting example of a wagering-game screen displaying a randomly selected outcome that includes special symbols 60*a*, 60*b*, and 60*c* located on adjacent reels 52*b*, 52*c*, and 52*d*. Accordingly, the special symbols 60*a*, 60*b*, and 60*c* provide a multiplying wild-symbol functionality, as shown in FIG. 20*b*. As illustrated in FIG. 20*b*, three distinct columns of a single, unified image 62 can be seen on reels 52*b*, 52*c* and 52*d*, and a multiplier of 3× is provided as enhanced functionality. In this illustration, the entirety of the single, unified image 62 is displayed to the player indicating that they received fullest possible functionality for this feature.

FIGS. 4 and 13, described by way of example above, represents one algorithm that corresponds to at least some instructions executed by the CPU 30 in FIG. 2 to perform the above described functions associated with the disclosed concepts.

Each of these embodiments and obvious variations thereof is contemplated as falling within the spirit and scope of the claimed invention, which is set forth in the following claims.

What is claimed is:

1. A computer-implemented method of operating a gaming system for conducting a wagering game, the method comprising:

receiving a wager in response to an input via at least one input device;

displaying, on at least one display device, a randomly selected outcome of the wagering game in a display area, the display area including a plurality of reels that display a plurality of symbols to form an array, the plurality of symbols including multiple ones of a special symbol;

in response to the randomly selected outcome including two or more of the special symbols in any symbol position on adjacent ones of the plurality of reels, changing the functionality of the special symbols on the adjacent ones of the plurality of reels and maintaining the functionality of any special symbol on non-adjacent ones of the plurality of reels to create a modified array;

in response to the randomly selected outcome including the two or more of the special symbols in any symbol position on the adjacent ones of the plurality of reels, replacing an image of each of the special symbols on the adjacent ones of the plurality of reels with an image of a modified special symbol and maintaining the image of each of the special symbols on the non-adjacent ones of the plurality of reels;

evaluating the modified array, using at least one of one or more processors, to determine whether or not the modified array includes a winning combination; and awarding a payout based on the modified array.

2. The computer-implemented method of claim 1, wherein the functionality of each of the special symbols on the adjacent ones of the reels is changed from a first functionality to a second functionality including a multiplier.

3. The computer-implemented method of claim 2, wherein the first functionality is a wild-symbol function and the second functionality is a multiplying wild-symbol function.

4. The computer-implemented method of claim 2, wherein the multiplier is based on a number of the adjacent reels on which the two or more of the special symbols are located.

5. The computer-implemented method of claim 2, wherein the multiplier is based on the number of special symbols located on the adjacent ones of the plurality of reels.

6. The computer-implemented method of claim 1, wherein the functionality of each of the special symbols on the adjacent ones of the reels is changed from a first functionality to a second expanding functionality.

7. The computer-implemented method of claim 6, wherein the first functionality is a bonus trigger function and the second functionality is an expanding bonus trigger function.

8. The computer-implemented method of claim 6, further comprising:

in response to the changing the functionality of the special symbols on the adjacent ones of the plurality of reels, determining at least one direction to expand each of the special symbols;

in response to the changing the functionality of the special symbols on the adjacent ones of the plurality of reels, determining a number of symbol positions in the at least one direction to expand each of the special symbols; and expanding each of special symbols on the adjacent ones of the plurality of reels according to the respective at least one direction and the number of symbol positions determined for the special symbols.

9. A gaming system comprising:

at least one electronic input device;

at least one electronic display device;

at least one processor;

at least one memory device storing instructions that, when executed by the at least one processor, cause the gaming system to:

receive a wager in response to an input via the at least one electronic input device;

display, on the at least one electronic display device, a randomly selected outcome of a wagering game in a display area, the display area including a plurality of reels that display a plurality of symbols to form an array, the plurality of symbols including multiple ones of a special symbol;

in response to the randomly selected outcome including two or more of the special symbols in any symbol position on adjacent ones of the plurality of reels, change the functionality of the special symbols on the adjacent ones of the plurality of reels and maintain the functionality of any special symbol on non-adjacent ones of the plurality of reels to create a modified array;

in response to the randomly selected outcome including two or more of the special symbols in any symbol position on adjacent ones of the plurality of reels, replace an image of each of the special symbols on the adjacent ones of the plurality of reels with an image of a modified special symbol and maintaining the image of each of the special symbols on the non-adjacent ones of the plurality of reels;

evaluate the modified array, using the at least one processor, to determine whether or not the modified array includes a winning combination; and award a payout based on the modified array.

10. The gaming system of claim 9, wherein the functionality of each of the special symbols on the adjacent ones of the reels is changed from a first functionality to a second expanding functionality.

11. The gaming system of claim 9, wherein the functionality of each of the special symbols on the adjacent ones of the reels is changed from a first functionality to a second functionality including a multiplier.

12. The gaming system of claim 10, wherein the at least one memory device storing instructions that, when executed by the at least one processor, further cause the gaming system to:

in response to the changing the functionality of the special symbols on the adjacent ones of the plurality of reels, determine at least one direction to expand each of the special symbols;

in response to the changing the functionality of the special symbols on the adjacent ones of the plurality of reels, determine a number of symbol positions in the at least one direction to expand each of the special symbols; and expand each of special symbols on the adjacent ones of the plurality of reels according to the respective at least one direction and the number of symbol positions determined for the special symbols.

13. The gaming system of claim 9, wherein the functionality of each of the special symbols on the adjacent ones of the reels is changed from a first functionality to a second functionality including a multiplier, the multiplier having a multiplier value based on the number of adjacent reels on which a special symbol is located.

14. The gaming system of claim 9, wherein the functionality of each of the special symbols on the adjacent ones of the reels is changed from a first functionality to a second functionality including a multiplier, the multiplier having a multiplier value based on the number of special symbols located on the adjacent ones of the plurality of reels.

15. The gaming system of claim 9, wherein the functionality of each of the special symbols on the adjacent ones of the reels is changed from a first functionality to a second expanding functionality.

* * * * *